US010710779B2

(12) United States Patent
Harris

(10) Patent No.: US 10,710,779 B2
(45) Date of Patent: Jul. 14, 2020

(54) MULTI-FUNCTION CONTAINER LID

(71) Applicant: Joel Harris, Toronto (CA)

(72) Inventor: Joel Harris, Toronto (CA)

( * ) Notice: Subject to any disclaimer, the term of this patent is extended or adjusted under 35 U.S.C. 154(b) by 0 days.

(21) Appl. No.: 16/723,305

(22) Filed: Dec. 20, 2019

(65) Prior Publication Data

US 2020/0140151 A1 May 7, 2020

Related U.S. Application Data

(62) Division of application No. 15/945,771, filed on Apr. 5, 2018, now Pat. No. 10,604,308.

(51) Int. Cl.

| | |
|---|---|
| ***B65D 43/02*** | (2006.01) |
| ***B65D 43/16*** | (2006.01) |
| ***B65D 51/18*** | (2006.01) |
| ***A47G 19/22*** | (2006.01) |

(52) U.S. Cl.

CPC ..... *B65D 43/169* (2013.01); *A47G 19/2272* (2013.01); *B65D 43/0204* (2013.01); *B65D 51/18* (2013.01)

(58) Field of Classification Search

CPC ..... A47G 19/2266; A47G 19/2272; B65D 43/0204; B65D 43/0206; B65D 43/021; B65D 43/0214; B65D 43/0216; B65D 43/022; B65D 43/161; B65D 43/162; B65D 43/163; B65D 43/164; B65D 43/165; B65D 43/166; B65D 43/167; B65D 43/168; B65D 43/169; B65D 51/18

USPC ..... 220/259.1

See application file for complete search history.

(56) References Cited

U.S. PATENT DOCUMENTS

| | | | |
|---|---|---|---|
| 4,232,797 | A | 11/1980 | Waterbury |
| 4,322,015 | A | 3/1982 | Bailey |
| 4,589,569 | A | 5/1986 | Clements |
| 4,738,373 | A | 4/1988 | DeParales |
| 5,244,113 | A | 6/1993 | Beck et al. |
| 5,392,949 | A | 2/1995 | McKenna |
| 5,398,843 | A | 3/1995 | Warden |
| 5,415,312 | A | 5/1995 | Mueller |
| 5,676,990 | A | 10/1997 | Wawrzynski |
| 5,699,927 | A | 12/1997 | Lane et al. |
| 5,839,601 | A | 11/1998 | Van Melle |
| 6,095,033 | A | 8/2000 | Melton |
| 6,202,542 | B1 | 3/2001 | Melton |
| 6,260,727 | B1 | 7/2001 | Durdon |
| 6,578,726 | B1 | 6/2003 | Schaefer |
| 6,889,859 | B1 | 5/2005 | Leon |

(Continued)

FOREIGN PATENT DOCUMENTS

| | | |
|---|---|---|
| GB | 2434737 B | 8/2007 |
| GB | 2446976 B | 6/2008 |

*Primary Examiner* — Joshua E Rodden

(57) ABSTRACT

A dome-shaped lid reversibly securably sealed to the rim of a container with two opposing drinking ports die-cut in the top wall of a brim mount. A reclosable fold-back hatch cover recessed within the brim mount rotates about a U-shaped hinge between a closed and opened position quickly and reliably. When the hatch cover is rotated to its opened position it creates a hatch opening of sufficient size to access the beverage for the following purposes, including, but not limited to, dunking a confection, letting steam escape to cool a hot beverage, adding condiments, stirring the beverage, or adding and removing toppings such as whipped cream on the surface of the beverage, performed with the lid remaining fixed to the container rim.

8 Claims, 23 Drawing Sheets

(56) References Cited

U.S. PATENT DOCUMENTS

| | | | |
|---|---|---|---|
| 6,978,910 | B2 | 12/2005 | Sanders et al. |
| 7,134,566 | B2 | 11/2006 | Smith et al. |
| 7,140,510 | B2 | 11/2006 | Portman et al. |
| 7,175,042 | B2 | 2/2007 | Durdon |
| 7,246,715 | B2 | 7/2007 | Smith et al. |
| 7,246,716 | B2 | 7/2007 | Durdon |
| 7,537,129 | B2 | 5/2009 | Bayss et al. |
| 7,594,584 | B2 | 9/2009 | Durdon et al. |
| 7,845,509 | B2 | 12/2010 | Burchard |
| 8,087,531 | B1 | 1/2012 | Riemer |
| 8,113,379 | B2 | 2/2012 | Cai et al. |
| 8,734,874 | B1 | 5/2014 | Paolone |
| 8,794,479 | B2 | 8/2014 | Lin |
| 9,078,535 | B1 | 7/2015 | Buck |
| 9,327,881 | B1 | 5/2016 | Saranga |
| 9,387,966 | B2 | 7/2016 | Chiang et al. |
| 9,409,685 | B2 | 8/2016 | Luis |
| 9,452,867 | B2 | 9/2016 | Koestring et al. |
| 9,475,619 | B2 | 10/2016 | Procter |
| 9,714,130 | B1 | 7/2017 | Edelman et al. |
| 9,725,214 | B2 | 8/2017 | Crosby |
| 9,908,667 | B1 | 3/2018 | Smith et al. |
| 2005/0092749 | A1 | 3/2005 | Durdon |
| 2007/0181581 | A1 | 8/2007 | Ross |
| 2009/0056556 | A1 | 3/2009 | Lin |
| 2012/0201941 | A1 | 8/2012 | Lavoie |
| 2012/0261417 | A1 | 10/2012 | Tabor et al. |
| 2013/0256307 | A1 | 10/2013 | Hewitt |
| 2015/0053090 | A1 | 2/2015 | Berger |
| 2015/0360839 | A1 | 12/2015 | Davis et al. |
| 2016/0137359 | A1 | 5/2016 | Bowlin |
| 2017/0112312 | A1 | 4/2017 | Gardeski |

MULTI-FUNCTION CONTAINER LID

FEDERALLY SPONSORED RESEARCH: N/A

| U.S. Classification: | D07/392.1 |
|---|---|
| D07 | Equipment for preparing or serving food or drink not elsewhere specified |
| 387 | element or attachment |
| 391 | Utensil cover |
| 392.1 | For china, glassware or serving vessel |

BACKGROUND

The following is a tabulation of some prior art that presently appears relevant:

U.S. Patents

| Cite No. | Pat. No. | Kind Code | Issue Date | Patentee |
|---|---|---|---|---|
| 1 | 9,908,667 | B1 | Mar. 6, 2018 | Smith, et al. |
| 2 | 9,725,214 | B2 | Aug. 8, 2017 | Crosby |
| 3 | 9,714,130 | B1 | Jul. 25, 2017 | Edelman, et al. |
| 4 | 9,475,619 | B2 | Oct. 25, 2016 | Procter |
| 5 | 9,452,867 | B2 | Sep. 27, 2016 | Koestring, et al. |
| 6 | 9,409,685 | B2 | Aug. 9, 2016 | Luis |
| 7 | 9,387,966 | B2 | Jul. 12, 2016 | Chiang, et al. |
| 8 | 9,327,881 | B1 | May 3, 2016 | Saranga |
| 9 | 9,078,535 | B1 | Jul. 14, 2016 | Buck |
| 10 | 8,794,479 | B2 | Aug. 5, 2014 | Lin |
| 11 | 8,734,874 | B1 | May 27, 2014 | Paolone |
| 12 | 8,113,379 | B2 | Feb. 14, 2012 | Cai, et al. |
| 13 | 8,087,531 | B1 | Jan. 3, 2012 | Riemer |
| 14 | 7,845,509 | B2 | Dec. 7, 2010 | Burchard |
| 15 | 7,594,584 | B2 | Sep. 29, 2009 | Durdon, et al. |
| 16 | 7,537,129 | B2 | May 26, 2009 | Bayss, et al. |
| 17 | 7,246,716 | B2 | Jul. 24, 2007 | Durdon |
| 18 | 7,246,715 | B2 | Jul. 24, 2007 | Smith, et al. |
| 19 | 7,175,042 | B2 | Feb. 13, 2007 | Durdon |
| 20 | 7,140,510 | B2 | Nov. 28, 2006 | Portman, et al. |
| 21 | 7,134,566 | B2 | Nov. 14, 2006 | Smith, et al. |
| 22 | 6,978,910 | B2 | Dec. 27, 2005 | Sander, et al. |
| 23 | 6,889,859 | B1 | May 10, 2005 | Leon |
| 24 | 6,578,726 | B1 | Jun. 17, 2003 | Schaefer |
| 25 | 6,260,727 | B1 | Jul. 17, 2001 | Durdon |
| 26 | 6,202,542 | B1 | Mar. 20, 2001 | Melton |
| 27 | 6,095,033 | | Aug. 1, 2000 | Melton |
| 28 | 5,839,601 | | Nov. 24, 1998 | Van Melle |
| 29 | 5,699,927 | | Dec. 23, 1997 | Lane, et al. |
| 30 | 5,676,990 | | Oct. 14, 1997 | Wawrzynski |
| 31 | 5,415,312 | | May 16, 1995 | Mueller |
| 32 | 5,398,843 | | Mar. 21, 1995 | Warden |
| 33 | 5,392,949 | | Feb. 28, 1995 | McKenna |
| 34 | 5,244,113 | | Jun. 15, 1993 | Beck, et al. |
| 35 | 4,738,373 | | Apr. 19, 1988 | DeParales |
| 36 | 4,589,569 | | May 20, 1986 | Clements |
| 37 | 4,322,015 | | Mar. 30, 1982 | Bailey |
| 38 | 4,232,797 | | Nov. 11, 1980 | Waterbury |

U.S. Patent Application Publications

| Cite No. | Publication Nr. | Kind Code | Publ. Date | Applicant |
|---|---|---|---|---|
| 1 | 2017/0112312 | A1 | Apr. 27, 2017 | Gardeski |
| 2 | 2016/0137359 | A1 | May 19, 2016 | Bowlin |
| 3 | 2015/0360839 | A1 | Dec. 17, 2015 | Davis et al. |
| 4 | 2015/0053090 | A1 | Feb. 26, 2015 | Berger; William Harold |
| 5 | 2013/0256307 | A1 | Oct. 3, 2013 | Hewitt |

-continued

U.S. Patent Application Publications

| Cite No. | Publication Nr. | Kind Code | Publ. Date | Applicant |
|---|---|---|---|---|
| 6 | 2012/0261417 | A1 | Oct. 18, 2012 | Tabor et al. |
| 7 | 2012/0201941 | A1 | Aug. 9, 2012 | Lavoie |
| 8 | 2009/0056556 | A1 | Mar. 5, 2009 | Lin; Shin-Shuoh |
| 9 | 2007/0181581 | A1 | Aug. 9, 2007 | Ross |
| 10 | 2005/0092749 | A1 | Mar. 5, 2005 | Durdon |

Foreign Patent Documents

| Cite No. | Publication Nr. | Kind Code | Publ. Date | Applicant |
|---|---|---|---|---|
| 1 | GB2446976 | B | Jun. 11, 2008 | Ross |
| 2 | GB2434737 | B | Aug. 8, 2007 | Ross |

Fast food outlets serve a variety of hot beverages each morning and throughout the day to be consumed by a mobile base of millions, if not billions of people. Often, along with these beverage purchases, the consumer will also buy snacks such as donuts, muffins, cookies, brownies, cakes and the like. One option, conspicuous by its absence in this array of fast food delights, is the biscotti.

Though modern biscotti (the generic name in Italy) are associated with the Tuscan region, this popular Italian cookie traces its origins to Roman times. Biscotti comes from the Latin panis biscotus—twice-cooked bread. They were baked first to cook them, then a second time to completely dry them out, making them durable for travel and nourishment on long journeys. The Roman biscotti were more about convenience food for travellers rather than a pleasurable treat for leisurely diners. The biscotti, historically, might be considered the first recorded example of fast food specifically designed for travelers, to be consumed by dipping into a drink, traditionally Vin Santo.

The biscotti is a hard biscuit shaped as a long stick curved on one side and flat on the other and has a recognizable shape and consistency, that is hard and dry to taste and difficult to bite and ingest without some form of liquid for dunking and softening purposes such as teas, coffees or wine for example.

The biscotti has evolved from the unleavened, twice-baked, oblong-shaped, dry, pallid, crunchy, fingers; dry staples for nourishment, to flavorings only limited to the imagination of the baker and the palates of the customer. The original almond recipe of Tuscany has expanded to anisette-, amaretto- and lemon-flavored dough and to other spices; to biscotti with raisins and other dried fruits, including biscotti studded with chocolate morsels and with other varieties of nuts. The biscotti are typically made in a variety of lengths approximately ranging from a 2" bite-size up to several inches in length. Their height and width, however, are more consistent; approximately 0.5 to 1.0 inch in height at the center, tapering to less than a half to a quarter inch in height at both ends. Their width is typically uniform, also with a characteristic narrow range, from some iterations no wider than a quarter inch or so to thicker versions reaching one inch. The aforementioned ingredients, sizes and shapes described for the biscotti do not preclude the availability of other recipes or dimensions not captured herein.

Eating biscotti in moderation offers a relatively low-calorie way to satisfy your sweet tooth. The fact that traditional biscotti recipes don't use any butter, oil or margarine makes this treat a healthier choice. Coffee, with a confection, has become a very important ritual for many starting their daily grind. Why not get the most enjoyment from this brief repast by choosing a confection with healthier ingredients, generating a unique taste experience when dunking this confection into your favourite beverage. The biscotti still enjoys an international following accompanying a traditional cup of coffee leisurely consumed throughout the day at many eateries. Ironically, however, the biscotti's classic history as a fast food staple for the traveler has not successfully made the transition into today's fast food life style.

The biscotti is meant to be dunked into a liquid then consumed. According to Wikipedia, dunking means to dunk or to dip a biscuit or some other food; to submerge it into a beverage, especially tea, coffee, or milk. Dunking releases more flavour from confections by dissolving the sugars, while also softening their texture. Dunking can be used to melt chocolate on biscuits to create a richer flavoured beverage. Evelyn, in the movie "The Best Exotic Marigold Hotel," poetically describes dunking as "lowering the biscuit into the tea and letting it soak in there and trying to calculate the exact moment before the biscuit dissolves, when you whip it up into your mouth and enjoy the blissful union of biscuits and tea combined." This unique beverage/confection experience has all but disappeared from the on-the-go fast food life style.

A possible explanation for the scarcity of confections such as the biscotti from fast food menus is that these "chip-your-tooth" biscuits must be softened by dipping into a drink in order to be consumed. To accomplish this the consumer must take the time to carefully remove the lid from a disposable container to access the beverage for dunking, delaying the consumer's progress towards their destination. Conversely, once the lid is removed from the container, the consumer might continue onto their destination while simultaneously attempting to dunk and consume the confection and occasionally sip from the cup. This option, however, introduces an element of risk which could result in possible spills and injury. A third, safer option for the consumer's consideration, is to keep the beverage sealed and the confection untouched, avoiding any delays, arriving at their destination where they can take the time to carefully disengage the lid from the container and start enjoying the unique experience of consuming a confection infused with their favourite hot beverage. Of course by that time the beverage may have cooled and lost some of the desired infusion benefits. There are certainly other scenarios which can be envisioned from the above, however, none offer the convenience and safety of both dunking and consuming a confection together with sipping a beverage while on the move with the lid firmly fixed to the container.

Dunking a confection into a drink container, whether to soften for consumption or to infuse for a more enjoyable beverage/confection experience, introduces processes which are at odds with the on-the-go habits promoted by the fast food industry, all but eliminating dunking and seeing a declining demand for confections such as the biscotti. Prior art lid/container assemblies were designed for the lid to remain attached to the container during the consumption of a beverage and then discarded, offering no lid/container assemblies where a consumer may access a beverage for dunking while the lid remains fixed to the rim of the container.

The management of lid/container assemblies for the purposes of accessing a beverage to dunk a confection may be impacted by many contributing factors. The initial clamping of a new disposable lid to the rim of a new disposable container filled with a hot beverage offers optimum sealing and snug fit, ensuring the contents will remain secure within the container eliminating spills and reducing splashing. Conversely, the removal of the same lid from the rim of a container soon after initial fixing to the rim may be difficult even for an experienced barrista. While sealing a disposable lid to a disposable container may seem simple enough, a barrista is more experienced and better trained to do this safely and effectively compared with a customer performing the same operation on an occasional basis, if at all. This is one of the knowledge, skills and abilities of the barrista and a key function during the delivery of a beverage to a customer. When the responsibility to secure the lid to the hot beverage container is downloaded to the customer, the repetitive practice and skill of this operation perfected by the barrista is absent and is further mitigated by the customers attention being distracted in any number of directions, escalating the potential for accidents. The risk of accident and injury does not diminish upon consumption of the confection but instead escalates if the customer chooses to quickly re-attach the disposable lid, and hurry on towards their destination.

The original seal between the lid and cup rim was not meant to last indefinitely but to maintain a tight connection over the short period of beverage consumption, satisfying its purpose of preventing spilling and splashing while offering safe access to sip the beverage with the added benefit of heat retention. The fast food beverage is served in a paper cup, not designed to retain its structure indefinitely under long contact with a hot beverage. The lid/rim interface may have been deformed when the lid was first affixed to the rim of the container and may further be deformed when the lid is pried off the first time for the purpose of dunking a confection. During the consumption of a confection the hot beverage has additional time to sweat into the cup, causing deterioration, weakening of the rim and reducing the rigidity of the paper wall forming the cup. As the consumer has expended unplanned time to consume the biscotti they may wish to expedite their departure and be on their way, quickly attempting to push the lid onto the rim, hopefully using a stable support such as a table or counter. The cup's weakened structure may result in a poor seal between the lid and the cup's rim and/or the cup wall might collapse vertically from the downward pressure of clamping the lid to the rim resulting in spills and possible injuries. Similarly, the consumer may have to grip and steady the cup to re-attach the lid, putting horizontal pressure on the walls of the cup by inadvertently squeezing the cup walls, again leading to the possible collapse of the cup walls and subsequent spills and injuries.

Once the lid is removed from a hot beverage container, for whatever reason, the portable nature of the fast food drink is diminished and the convenience and safety offered by the cup lid has been compromised. Consumers on the move have no practical way to safely dunk a biscotti or other confection to respectively necessitate softening and/or enhance beverage consumption, while ensuring the container contents does not spill. The lid must be removed to accomplish this, inviting accidents. The typical consumer chooses a fast food hot beverage outlet so they can obtain a drink and continue onward. Consequently, confections such as the biscotti introduces a paradigm shift away from this routine delaying the consumer from reaching their destination in a timely manner, helping to explain why the biscotti is in less demand as a confection, left behind the dessert glass, gradually disappearing from many fast food outlets, denying the consumer a more enhanced beverage/confection experience.

The prior art does not disclose any disposable cup lids specifically designed to offer access to a hot beverage for the purposes of dunking a confection such as a biscotti while the disposable lid remains fixed to the cup rim. The consumer's only option for dunking a biscotti into their fast food beverage is to decline having the barrista affix the lid prior to delivering the beverage or for the consumer to remove the lid from the rim of the cup after receipt of the beverage.

To enable a consumer to both sip a hot beverage and consume a beverage infused confection while on-the-go requires a suitably modified disposable lid facilitating dunking a confection, such as a biscotti, repeatedly without the necessity of first removing the lid to access the beverage in the container.

This new invention allows confections, such as the biscotti, to regain their position among fast food treats, introducing both old and new on-the-go beverage consumers to a unique beverage confection experience that is truly meant to be enjoyed while on the move.

Disadvantages of the Prior Art

There are no prior art patents specifically describing dunking a confection, such as a biscotti or the like, through the top of a disposable lid attached to the rim of a disposable container into a hot or cold beverage without first removing the lid. There is, however, prior art which teach the addition of condiments through an opening centred in the top of a disposable lid attached to the rim of a disposable container. Other prior art patents disclose similarly centered openings in the tops of disposable lids for the purposes of introducing organically, flavoured infusions materials such as tea leaves or an infusion pouch such as a tea bag, into an infusion chamber, basket or a centrally positioned perforated funnel, extending from the underside surface of a disposable lid for the purposes of infusing the beverage contents in a disposable beverage container.

One might argue that these prior art references might be suitably adopted for the purpose of dunking a confection, such as a biscotti or the like, through the top of a disposable lid into a beverage in a disposable container without first removing the lid from the container. However, the following disadvantages outlined below highlight the drawbacks of these prior art patents, which hamper the smooth execution of the dunking process, as possible options for dunking a confection such as a biscotti or the like through the top of a disposable lid into a beverage in a disposable container for the purposes of achieving an enhanced on-the-go beverage/confection experience.

U.S. Pat. No. 7,175,042, issued to Durdon on Feb. 13, 2007, teaches a disposable cup lid 10 (FIG. 1) with a condiment opening 28 (FIG. 1) in the top wall. Cup lid 10 is structured in such a manner that when placed on drinking cup 14 (FIG. 1), the user may add condiments to the beverage in cup 14 without having to remove lid 10 from cup 14. A flexible arm 24 (FIG. 1) is integrally formed with the rim portion 20 (FIG. 1) around the periphery of lid 10. Flexible arm 24 extends outwards with a sealing member 30 (FIG. 1) at an end remote from arm/rim 24/20 interface for sealing/closing the condiment opening 28 centred on the top surface of lid 10 when condiment opening 28 is not in use.

Condiment opening 28 in this prior art is designed to be larger than drinking access port 26 on cup lid 10. This is to enable a more expedited delivery of condiments through lid 10 into cup 14 beverage without removing lid 10. However, condiment opening 28 is still not sufficiently large enough to allow a consumer to smoothly dunk and retrieve a confection such as a biscotti or the like through lid 10 into the beverage below. Condiment opening 28 is not meant to remain open for any extended period, such as that necessary for dunking and consuming a confection such as a biscotti. Condiment opening 28 needs to be larger than drinking access port 26 to facilitate delivery of condiments without removing lid 10, but then condiment opening 28 is to be sealed once condiments have been delivered. Durdon has designed condiment opening 28 to be of limited diameter to prevent spills and splashes when opened. This prior art was not designed to be optionally used for dunking a confection because the diameter of condiment opening 28 is too small; nor is there any suggestion in this prior art that condiment opening 28 could be suitably adopted for dunking a confection.

The flexible arm 24, integral to rim 20, forms a raised curved shape when sealing member 30 is engaged to condiment opening 28 for sealing condiment opening 28 when not in use. Arm 24 is conspicuous as it does not form a low planar profile in intimate contact with the top surface of lid 10. Instead, arm 24 is curved, raised above the top surface of lid 10, forming a substantially semi-circular space between the top surface of lid 10 and the bottom surface of curved arm 24, connected at opposing ends, respectively, to rim 20 and sealing member 30. This space presents a potential location to be caught or snared on the consumer's fingers, or other objects, potentially pulling sealing member 30 from condiment opening 28 or pulling the entire lid 10 from cup rim 12 (FIG. 1), leading to spills and possible injury.

Conversely, when sealing member 30 is not engaged to condiment opening 28, sealing member 30 and arm 24 are unrestrained, raised above condiment opening 28, free to randomly move vertically or laterally in sync with the motion of the customer moving while holding cup 14, providing potential opportunity for the exposed sealing member 30 and arm 24 to interfere when adding condiments through condiment opening 28 or to become accidentally ensnared by fingers, hand, or other objects, potentially pulling lid 10 from container rim 12 resulting in splashing, spills and possible injury. Unrestrained sealing member 30 and arm 24 may interfere with the consumer's nose and the upper part of the face and even the consumer's hair should the consumer choose to sip beverage from the drinking access port 26 while sealing member 30 is unrestrained to make contact with the consumer's face and head.

Flexible arm 24, between sealing member 30 and lid rim 20, may encourage improper disengagement of sealing member 30 from condiment opening 28 by attracting the consumer to grasp flexible arm 24 to expedite disengagement of sealing member 30 from condiment opening 28 rather than gripping tab 31 (FIG. 1), on sealing member 30, specifically designed to pry sealing member 30 from condiment opening 28. This too could result in prying lid 10 from cup 14 rim 12 leading to spills and injury. This would be similar to a plug being pulled from a wall receptacle by the cord and not directly by the plug at the receptacle/plug interface.

Although this patent offers access to the beverage without removing lid 10, such access is limited by size and design of condiment opening 28 which, respectively, cannot accommodate the smooth dunking and retrieval of a confection such as a biscotti and which promotes other disadvantages leading to possible accidents.

U.S. Pat. No. 7,246,716, issued on Jul. 24, 2007, to Durdon, teaches an alternative disposable cup lid 10 (FIG. 1) with a condiment opening 34 (FIG. 2) compared with Durdon's earlier patent, above. In this prior art patent cup lid 10 is structured with a reclosable and tearable hinged 28 (FIG. 1) fold-back condiment tab 30 (FIG. 1) integrated within the top wall of the lid 10 with fault lines 38 in the first planar region 20 of the top wall. The foldable condiment tab 30 forms a hinged semi-circle with an upstanding post 40 (FIG. 1) with a recess 32 (FIG. 1) in the opposite adjacent planar semi-circle to frictionally receive post 40 when condiment tab 30 is folded back. When not in use, condiment opening 34 is reclosable via condiment tab 30 by releasing post 40 from being frictionally held in recess 32. When cup lid 10 is placed on cup 14, the user may add condiments into cup 10 without having to remove lid 10 from cup 14.

The semi-circular shape and size of condiment opening 34 is not wide enough to accommodate the unencumbered repeated dunking and retrieval of a confection such as a biscotti of varying dimensions. When the confection is advanced through condiment opening 34 it may make contact with the sides of the opening and become wedged in the opening, unable to advance further or be retrieved without breaking apart or requiring the consumer to physically disassemble lid 10 from cup 14 to free the confection from the opening. This narrow surface opening and shape may lead to the confection breaking apart during the dunking and retrieval process. Such contact will cause a confection such as a biscotti to break away from its larger mass, dropping bits of the confection into the beverage, never softening for ingestion nor achieving the desired beverage/confection experience.

The semi-circular fold-back access tab 30 is held in position in the top wall of lid 10 by either pre-cut fault lines 38; scored fault lines; or serrated fault lines. Regardless of the fault lines 38 adopted, condiment tab 30 must be opened by either pushing downward or gripping upstanding post 40, as recommended in the patent, and pulling it upwards, to tear the pre-scored edges 38 to enable hinge 28 to rotate tab 30 backwards to access to the beverage through the created opening 34.

Choosing to push tab 30 downwards requires sufficient force such that tab 30 breaks free from scored fault lines 38 holding it in a planar 20 position in the top wall of lid 10. Tab 30 may be forced downward by two fingers gripping upstanding post 40. Alternatively, a finger or thumb might be used to force tab 30 downward, breaking scored fault lines 38. Depending on the level of the beverage, combined with the force needed to break fault lines 38, such downward pressure may cause the fingers to contact the surface of the beverage, leading to spills or possible injury. Using a single finger or thumb to push tab 30 downwards and disengage fault lines 38 may result in pushing the finger into a wedged position between the edge of the perimeter wall around condiment opening 34 and the edge of tab 30. The depth the finger is extended downward to break tab 30 from fault lines 38 may bring the finger in contact with the surface of the liquid, with the competing edges of tab 30 and the inside perimeter wall of condiment opening 34, thereby wedging the finger in condiment opening 34 and submerged in a hot beverage. This may lead to burns, and a reflex reaction by the consumer to pull the finger out, disengaging lid 10 from cup 14, spilling the contents and leading to more burns and possible cuts to the finger from the edges of the inside perimeter wall the around condiment opening 34 and the edge of tab 30.

Alternatively, when gripping upstanding post 40 to pull tab 30 upward to release it from scored fault lines 38, may require such force as to pull lid 10 off rim 12 of cup 14, possibly spilling the contents. Conversely, the dimensions of post 40 may not be suitably gripped by all persons with varying finger dimensions, forcing the consumer to push tab 30 downwards to break free to access condiment opening 34. Once depressed, tab 30 will still need to be pulled upwards and rotated again requiring the consumer attempt to grasp an edge of tab 30 or post 40, which may not be possible. This could lead to further frustrations and potential spilling of cup 14 contents.

In either approach towards releasing tab 30, the consumer's free hand must be utilized to steady cup 14 while depressing tab 30 down or pulling tab 30 upwards. As the hot beverage weakens cup 14 walls, the consumer's grip on cup 14 may increase possibly causing the collapse of cup 14 walls inward adding further risk of spilling and injury. Alternatively, resistance to breaking scored fault lines 38 to release tab 30 may lead to adopting a stir stick, or other device, to force tab 30 downwards to break scored 38 contact areas. This too can lead to accidents such as piercing the bottom of cup 14 if too much downward force is applied.

Collectively the disadvantages described above do not support this prior art as being suitably adopted to allow for dunking of a confection such as a biscotti or the like into a beverage without first removing lid 10.

U.S. Pat. No. 9,327,881, issued on May 3, 2016 to Saranga et al., teaches an all-in-one lid dispenser containing condiments and additives to be added to a beverage or food container. There are raised sections on the top wall containing these additives and condiments. When they're depressed by the consumer they cause punches to separate the dispensing flaps from the panel below. The condiments or additives which are contained in between the top and bottom panels flow through the dispensing flap holes into the beverage or food. These dispensing panels offer no solution to dunking a confection such as a biscotti without removing the container lid. However, an access hole 118 (FIG. 1), provides direct access to the food or beverage inside the container. Access hole 118 in the top wall of the lid is used to mix the container contents and offers a possible entry point for dunking a biscotti or other confection. However, this opening, like the others listed above, is too small to accommodate a confection such as a biscotti for dunking.

U.S. Pat. No. 6,889,859, issued May 10, 2005 to Leon, teaches a hinged E1, "D" shaped hatch E in the top wall of the lid to access the beverage in the container to add and stir condiments while the lid remains fully installed on the cup. Hatch E is not wide enough for a confection such as a biscotti to clear the "D-shaped" inside perimeter edge of the hatch opening. This is consistent with the aforementioned prior art references which offer access to the beverage through the lid, via an opening, marginally larger than the drinking access port, with the primary role of delivering condiments, while minimizing splashing through this opening. A stir stick is used to apply downward pressure pushing hinged E1 hatch E below the top wall of the lid, towards the surface of the beverage in the cup. After condiments are added the stirring stick is pulled upward bringing hinged E1 hatch E flush with the top wall of the lid. The stir stick is required to keep hatch E open, obstructing a confection such as a biscotti from smoothly being dunked and retrieved into and out of the beverage. Even if hatch E is hinged E1 downwards and the stirring stick is removed, a confection such as a biscotti cannot enter the hatch opening without becoming wedged between the perimeter edge around hatch E and the inside perimeter edge around the opening, causing the confection to be chipped or break apart.

U.S. Patent Application Publication No. 20130256307, issued Oct. 3, 2013 to Hewitt, teaches a cover 1 (FIG. 1) for a cup having an arcuate shaped hinged lid 14 (FIG. 1) integral to the top wall of cover 1. When lid 14 is folded back it exposes an arcuate shaped opening 12 (FIG. 3) bordered with an inside perimeter continuous flange 23 (FIG. 3) to which the opened end of mesh or other membrane forming a permeable pouch 22 (FIG. 1) is secured around the outside wall of continuous flange 23 (FIG. 3). Lid 14 may be optionally opened or closed. When lid 14 is opened it allows tea leaves, ground coffee and the like to be inserted into mesh or net forming pouch 22 for the purposes of infusing water or other liquid in container 2.

Opening 12 below lid 14 is marginally larger then the openings described in the above prior art references. However, this opening is still not of sufficient size to accommodate a confection such as a biscotti baked in a variety of dimensions for the purposes of dunking into a beverage. The sides of the confection will make contact with the sharp edge of the perimeter inside wall crumbling into the infuser basket and subsequently breaking down further, where fine particles from the confection will clog the mesh or pass through into the beverage.

A further obstacle to adopting cover 1 for dunking a confection is the barrier created by mesh pouch 22 to access the full depth of the beverage in container 2. This prior art patent does not promote the dunking of a confection such as a biscotti through opening 12 as only a small portion of the confection would be submerged into the limited depth of pouch 22. With each subsequent dunking and retrieval the level of the beverage occupying pouch 22 would rapidly decline to a point where the surface of the beverage in the container would fall below the bottom of pouch 22 removing beverage necessary for dunking. The depth of beverage available in the infusion pouch for dunking would also diminish as the beverage is consumed with no way of bypassing the pouch to access beverage below the base of the pouch for suitable dunking.

Another reason why cover 1 would not be adopted for the purposes of dunking a confection such as a biscotti is that pouch 22 is designed to retain an organically flavoured infusion pouch such as a tea bag or loose tea leaves for the duration the beverage is consumed at which time the cup, lid and depleted tea bag or leaves, and the like, are discarded. While a tea bag may be easily retrieved from mesh pouch 22, loose tea leaves are not so easily removed from the pouch. The depleted tea leaves or tea bag residing in pouch 22 is not an attractive accompaniment when considering adopting cover 1 for the purposes of dunking a confection such as a biscotti into the pouch. Any confection dunked into the basket would mingle with any remaining infusable material such as tea leaves. The leaves could adhere to the biscotti upon retrieval and be accidentally consumed. Also, the perforated wall of the infuser mesh may itself become clogged with the remnant infuser material, reducing the amount of beverage which may reside in the basket area available for dunking. This may require the lid be removed from the cup to initiate dunking and consumption of a confection such as a biscotti. Further, the mesh infuser receptacle in Hewitt's art may be difficult to pry open to receive a confection and may subsequently tear or become entangled with a confection, causing some of the confection to break and dislodge as smaller pieces into the liquid. It is also important to note that the dunking process is time sensitive, designed to leave a confection such as a biscotti in the hot beverage to soften but not too long such that the confection disintegrates. In the absence of adequate beverage the lid may have to be removed for the purposes of dunking a confection.

U.S. Patent Application Publication No. 20150053090, issued Feb. 26, 2015 to Burger, has similar disadvantages with that of Hewitt's patent above as an option for dunking a confection such as a biscotti through a fixed lid/container assembly. Burger teaches a cup lid designed into a single integrated piece comprising an annular cover 204 with a D-shaped perforated infuser basket 201 reversibly attached to a container. In this example infuser basket 201 is made from a resilient material which can be moulded as apposed to the permeable mesh pouch described by Hewitt.

FIG. 1 is a perspective view of the integrated cup lid assembly with D-shaped infuser basket 201, reversibly attached to a container. Note the surface line representing beverage height in FIG. 1. The height of the beverage is well above the base of infuser basket 201 but is too shallow to offer a suitable depth of beverage for dunking a confection, such as a biscotti. This shallow reservoir of available beverage will quickly disappear for dunking once dunking begins and the loss of available beverage will be further expedited as the consumer consumes the beverage. Basket 201 does not allow a confection to be dunked further into the beverage beyond the surface as the height of the beverage recedes due basket's 201 moulded design and solid base. There is also the issue of residual infusion material such as loose tea leaves, retained in basket 201, which would mingle and attach to a confection should dunking be attempted into this basket. FIG. 2A is a top view of cover 204 and shows the limited surface area available in the opening to receive randomly oriented confections of varying dimensions for the purposes of dunking into a liquid with the likely result of the confections breaking apart through contact with the sides of the opening. This may require the lid be removed to complete dunking and consumption of a confection such as a biscotti.

U.S. Pat. No. 6,202,542, issued Mar. 20, 2001 to Melton, similarly teaches an infuser basket described as a one-piece body 18 (FIG. 1) with a circular opening or well 38 (FIG. 1) centrally positioned in the top wall of the infuser unit 10 (FIG. 1) integral to the reverse side of top wall of infuser unit 10 with a separate cover 650 (FIG. 10) to cover well 38. Cover 650 is attached to infuser unit 10 by a flexible strip or attachment piece 722 (FIG. 10). This design offers a more central annular opening in the top wall of the cover which might be considered for dunking a confection such as a biscotti or the like. FIG. 2 is an exploded vertical cross-sectional view of infuser unit 10 showing infuser basket 18 with a generally circular wall 41 and a preferably tapered form, extending downwards from countersink wall 40 into the cup interior to form well 38. While the top end of the circular opening or well 38 may, at first, suggest a limited number of confections of suitable size might be accommodated when dunking is initiated, such confections will not advance downwards very far before they will become wedged in the tapered constricting well 38, hampering their advancement downwards denying the confection access with any usable amount of beverage high enough in the cup to occupy the infuser basket 18. As well Melton's patent suffers from the disadvantages described above for the Hewitt and Burger patents as unsuitable lids for the purposes of dunking a confection such as a biscotti or the like, without the need to first remove the lid to access the beverage. As a further note, flexible strip or attachment piece 722 also suffers from the same disadvantages describe for Durdon's arm 24 in U.S. Pat. No. 7,175,042.

The primary inventiveness of the aforementioned prior art is to deliver condiments through a resealable opening in the top wall or surface of a disposable or non-disposable lid into a beverage in a container or to introduce an organic infusion product such as tea leaves through an opening in the top wall of a disposable or non-disposable lid, into an infusion receptacle to infuse water or other beverage passing through the infusion receptacle. In both these scenarios the addition of condiments or infusion products was accomplished without the necessity of removing the lid from the container rim to access the beverage. At no time does the prior art mention adapting or optionally utilizing the condiment or infusion opening in the lid for the purposes of dunking a confection into a beverage, nor was there any suggestion of modifying the condiment/infuser opening in the top wall of the lid for the purpose of dunking a confection such as a biscotti or the like to avoid the necessity of first removing the lid from the container.

Confections, such as biscotti and the like, are either specifically designed to be dunked into a beverage for softening or at least offer dunking as an option to the consumer. Dunking a confection is not a new practice; many confections have been dunked into a beverage which do not require the necessary softening, such as that suggested for a biscotti, to be properly and more easily consumed. Cookies, such as "Oreos," have been dunked into milk, yet can be easily consumed without a liquid softening this biscuit. The fast food company "Dunkin' Donuts®" is named for the very purpose of dunking a confection such as a donut into a beverage, ironically however Dunkin' Donuts®" does not offer a beverage lid assembly which allows the consumer to dunk a donut through the top of a disposable lid into a beverage without the necessity of first removing the lid from the cup rim.

Confections such as a biscotti and other biscuits designed to be dunked into a beverage have been readily available prior to, during, and following the introduction and expansion of the fast food beverage industry. The biscotti is not some obscure confection but one that has been offered, albeit less and less, at fast food establishments and related take-out services offering beverages on-the-go. The biscotti is still offered as a confection option when having a more leisurely hot beverage following a meal or a beverage served in a conventional coffee cup resting on a saucer, not meant to be carried on the sidewalk and consumed while on-the-go. The fast food hot beverage take-out industry's proliferation and has seen the biscotti become conspicuous by its absence as a confection selection when ordering a hot beverage to go in a disposable cup/lid container assembly. Despite the history and widespread consumption of confections specifically adopted to be dunked in a beverage, combined with the extensive prior art iterations offering a variety differently designed disposable beverage lids and containers over the past 50 years, no attempt has been made to introduce a disposable beverage container lid designed for receiving a confection for dunking without the necessity of first removing the lid from the rim of a disposable container.

This assessment of the prior art and related searches demonstrates the non-obviousness of the present invention where persons with ordinary skill, experience and familiarity with the design of disposable hot beverage lids and containers, as well as having been exposed too, and very likely consuming a variety of confections, including a biscotti, did not make the connection of introducing a disposable lid with access for dunking a confection into the beverage contained in a container without the necessity of removing the lid.

Despite the exhaustive list of prior art dating back several decades, when the biscotti was more readily available compared with today, there has been a failure to recognize the need to invent a disposable or non-disposable container lid which allows a confection such as a biscotti or the like to be dunked through an opening in the top wall of a lid into a beverage and made available to the masses of daily, on-the-go beverage consumers.

The above disadvantages of one or more aspects of the prior art, do not allow for randomly oriented, unencumbered access dunking of a confection such as a biscotti through the top of a disposable lid, while the lid remains fixed to the rim of a container. These limitations impact on the application of such prior art lids as suitable options to be adopted for dunking a biscotti without the disposable lid being removed from the cup rim.

An alternative disposable lid invention is described as follows, overcoming these limitations and introducing a new disposable or non-disposable lid for accessing a liquid for the purpose of dunking a confection such as a biscotti or the like. Several unexpected advantages have also been realized which are new or improve upon the prior art disposable/non-disposable lid options.

SUMMARY

In several of its preferred embodiments, a container lid is provided which is releasably mounted to a container having a cover portion or vessel forming assembly, with the rim portion sealing securably engaged, reversibly clamping the edge of the lid safely and reliably to the beverage container without the risk that the lid may become inadvertently detached from the container. The cover portion of the lid comprises at least a first and second substantially planar regions. The first planar region forms an elevated annular top tract panel ring-shaped brim mount comprising an annular outside wall, a mainly annular top transition surface and a mainly annular curved inside wall with primary and secondary drinking access ports positioned diametrically at opposing ends punched through the top surface of the brim mount in direct communication with the beverage.

In accordance with one embodiment of the present invention, the second planar region comprises a recessed centrally positioned, flexibly integrated mainly annular reclosable fold-back hatch cover in the top surface of the lid in the closed position within the curved inside wall of the brim mount. The recessed hatch cover accommodates the lip and nose of the consumer when tilting the cup and drinking from the primary drinking access port. A variable U-shaped hinge, adjacent the primary drinking access port, is recessed along one side of a portion of the top transition surface of the brim mount, connecting indirectly to the reclosable hatch cover through an interposed rigid connecting panel and a vertical flexible articulating wall. On the opposing side of the hatch cover, an arcuate tab is in intimate contact with the top transition surface of the brim mount concealing the secondary drinking access port. A gripping post protruding from the top surface of the arcuate tab is pulled upwards, rotating the hatch cover 180 degrees, releasing it from the reversible closed position to a fold-back position behind the hinge thereby exposing a centrally positioned, substantially annular-shaped hatch opening within the curved inside wall of the brim mount.

Two alternative embodiments are presented for retaining the hatch cover in the reversibly closed position. In one embodiment, the channel portion of a peripheral rib/channel around the perimeter of the hatch cover is frictionally mated to a ridge rib formed around the inside perimeter of the curved inside wall of the brim mount. In an alternative embodiment, the reclosable hatch cover is retained in the closed position by a downstanding vertical snap-fitting post below the arcuate tab, frictionally snap-fitting into the secondary drinking access port.

Once the reclosable hatch cover is pivoted away from the hinge, there is unobstructed access to the beverage through the hatch opening. The hatch opening has a sufficiently large enough surface area to accommodate a plurality of confections of different shape, composition and dimensions, including, but not limited to biscotti, such that these confections may be safely dunked, easily immersed to varying depths through the hatch opening into a hot or cold beverage, obviating the necessity, disadvantages and risks of prying the lid from the container rim to access the beverage and possibly leading to spills and accidents. Aside from dunking a confection, the consumer might also utilize the hatch opening to expedite cooling of the beverage, add condiments or an infusion pouch, scoop out toppings such as whipped cream or more effectively stir the beverage, while the lid remains fixed to the rim of the container.

The hatch opening and lid may be any shape, however, a circular shape conforms with standard lids and containers for accessing a hot or cold beverage, but this does not preclude a square shaped hatch and cover from being adopted. The hatch cover and arcuate tab have been designed to allow the lids to be stacked for access and space accommodations.

The arcuate tab also includes a string guide hole and a string entry slit, ruptured along one edge of the arcuate tab. A string attached to an infusion pouch enters through the slit into the connected string guide hole for the purposes of sliding an infusion pouch attached to a string in and out of the beverage container through the hatch opening.

This new invention introduces a lid with many novel features which were not anticipated, rendered obvious, suggested, or even implied by any of the prior art disposable lids, either alone or in any combination thereof.

The foregoing and numerous other objects, features and advantages of the present invention will become readily apparent upon a reading of the detailed description, claims and drawings set forth herein. Other advantages of one or more aspects will become apparent from a consideration of the drawings and ensuing description.

DETAILED DESCRIPTION OF DRAWINGS

Figure 1:
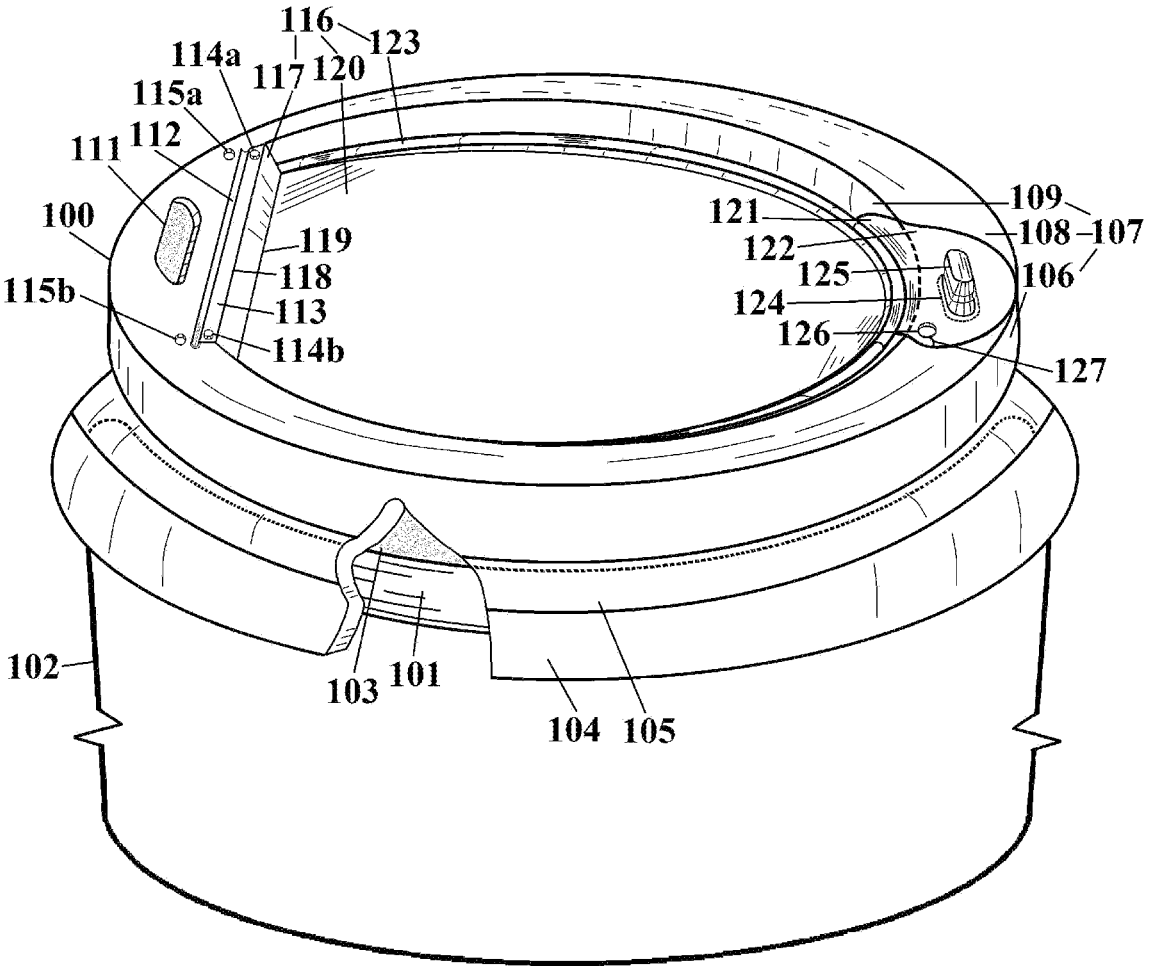
FIG. 1 is a perspective view of a container lid shaped and sized to fit over a container with a portion of the lid cut-away to expose the engagement of the rim of the lid to the rolled rim of the container.

The novel features which are believed to be characteristic of the present invention, as to its structure, organization, use and method of operation, together with further objectives and advantages thereof, will be better understood from the following discussion.

The present invention provides a container lid covering the open end of a container, wherein the dunking of a confection into a beverage within the container is desirable by the consumer without the necessity of first removing the lid from the rim of the container. A variety of confections such as biscotti, lady fingers, or the like, of suitable dimensions may be selected by the consumer for dunking through the hatch opening in the top of the lid. The consumer may also take advantage of the hatch opening in the lid for other operations involving the container contents including, but not limited to, cooling the beverage, adding condiments, stirring the beverage, scooping out toppings such as whipped cream with the aid of a spoon when such toppings are included for some beverages such as café mocha or hot chocolate, or infusing the contents with an organically flavoured infusion pouch such as a tea bag. The container may be used to carry both hot and cold beverages including, but not limited to, coffee, tea, hot chocolates, iced tea, iced coffee, cappuccino, and the like.

The invention will hereafter be described with reference to the accompanying drawings, wherein like reference numerals denote like elements, and it will be understood that the foregoing description is of preferred exemplary embodiments of this invention and that the invention is not limited to the specific forms shown. Other modifications may be made in the design and arrangement of the elements without departing from the scope of the invention as expressed in the appended claims.

Referring first to FIGS. 1, 1A, 2, 2A, 3, 3A, 4, 5, 5A, 5B, 6, 6A and 6B, a first embodiment of container lid 100 in keeping with the principles of the present invention is shown in FIG. 1, where lid 100 is dome shaped, sized to fit over, and reversibly, securely seal, in a conventional manner, to a peripheral rolled rim 101 around the periphery of the open top end of a container 102 made in a suitable manner (compressed for ease of illustration). Dome shaped lids are particularly suitable for containers 102 holding beverages 103 which have some froth or foam on their surface or added toppings, such as whipped cream.

Lid 100 comprises an annular configuration to conform to the shape and size of the open top of container 102 including a circumferential outer perimeter annular continuous flange 104 and a circumferential annular inclined transition flange 105 depending radially inward with a low angle inclining slant from the top of continuous flange 104 to the base of an annular outside wall 106. The cut-away portion on the outer perimeter of lid 100 exposes flanges 104 and 105 working in combination as rim-engaging means adapted to engage a container 102 rolled rim 101 in a mutually semi-releasable locking relationship. Flanges 104 and 105 clamp lid 100 safely and reliably to container 102 without the risk that lid 100 may become inadvertently detached from container 102 or fall off, thereby preventing leakage of container 102 contents at the interface between lid 100 and rolled rim 101.

A first elevated planar region forms an elevated annular top tract panel ring-shaped brim mount 107 comprised of an outside wall 106, upwardly dependent from the top of transition flange 105, to the top of a mainly annular top transition surface 108, inwardly dependent from outside wall 106, terminating at the top of mainly annular curved inside wall 109, which is downwardly dependent from top transition surface 108. Curved inside wall 109 has a mainly annular inside stiffening retaining ridge rib 110 (not shown, see FIGS. 1A, 3 and 3A) around the inside periphery.

Two, diametrically opposite, drinking access ports, in direct communication with beverage 103 are die-cut into top transition surface 108. Primary drinking access port 111 is positioned between the outside edge of top transition surface 108 and a resilient, recessed, variable U-shaped hinge 112, formed at least partially along a chord bisecting top transition surface 108. Hinge 112 connects to planar rigid connecting panel 113, whereby twin, low profile, spaced, upstanding opposing posts 114*a* and 114*b* protrude at opposite ends from the top surface of rigid connecting panel 113. Twin, low-depth, spaced, dimensionally larger, opposing cavities 115*a* and 115*b*, are formed in top transition surface 108, respectively, opposite posts 114*a* and 114*b* on the other side of hinge 112. Twin posts 114*a* and 114*b* and twin cavities 115*a* and 115*b*, respectively, are equidistant from each other, on either side of hinge 112.

A second, recessed, substantially planar region forms a recessed centrally positioned, flexibly integrated mainly annular reclosable fold-back hatch cover 116 in the closed position within curved inside wall 109. Hatch cover 116 is comprised at one end by a substantially vertical flexible articulating wall 117 joined at the top to rigid connecting panel 113 by a first articulating fold 118. Articulating wall 117 is downwardly dependent from rigid connecting panel 113 to a second articulating fold 119 which joins the base of articulating wall 117 to inclined top surface 120. Inclined top surface 120 slants downward from second articulating fold 119 at the base of articulating wall 117 to an undulated-shaped inclined transition gradient 121, which in turn ascends upwards connecting to a horizontally planar, arcuate tab 122. A mainly annular peripheral stiffening rib 123 forms around the periphery of inclined top wall 120.

Arcuate tab 122, distal from articulating wall 117, rests in intimate contact with top transition surface 108 concealing secondary drinking access port 124 die-cut into top transition wall 108. An upstanding vertical gripping post 125 protrudes from the surface of arcuate tab 122. Arcuate tab 122 has a die-cut string guide hole 126 connected to die-cut string entry slit 127 ruptured from one edge of arcuate tab 122.

In a preferred embodiment of the present invention, hatch cover 116 is designed to accommodate the lip and nose of the consumer when the consumer is tilting container 102 and drinking from primary drinking access port 111, whereby a sufficient amount of air easily enters into beverage container 102, equalizing the pressure, thereby permitting a more usual drinking procedure from the suitably sized primary drinking access port 111 rather than an essentially sucking procedure.

The preferred material for container lid 100 with hinge 112 and hatch cover 116 is a resilient material including but not limited to thermoplastic, non-thermoplastic, rubber, or paper that can be moulded and offering contact lubricated properties for easy closing and opening of hatch cover 116. Container 102 may be made from materials including but not limited to thermoplastic or non-thermoplastic, rubber, metal or paper. Hatch cover 116 may be any shape, however, a circular shape on a round lid offers substantial allowable access to beverage 103, but this does not preclude a square-shaped hatch cover from being adopted. Size may vary marginally to the extent that a confection may be dunked through the hatch opening in an unencumbered manner.

Lid 100 may be manufactured by a variety of manufacturing processes, such as injection moulding or a thermoforming operation, preferably vacuum forming and/or pressure forming from extruded polystyrene material. Preferably lid 100 is formed from a one piece construction blank ensuring the hatch cover 116 is integrally formed with lid 100 requiring no separate steps in the formation process. This single piece construction can be achieved when a thin sheet of polystyrene is extruded and, while still hot, delivered into a vacuum/pressure mould using male and female dies.

Figure 1A:
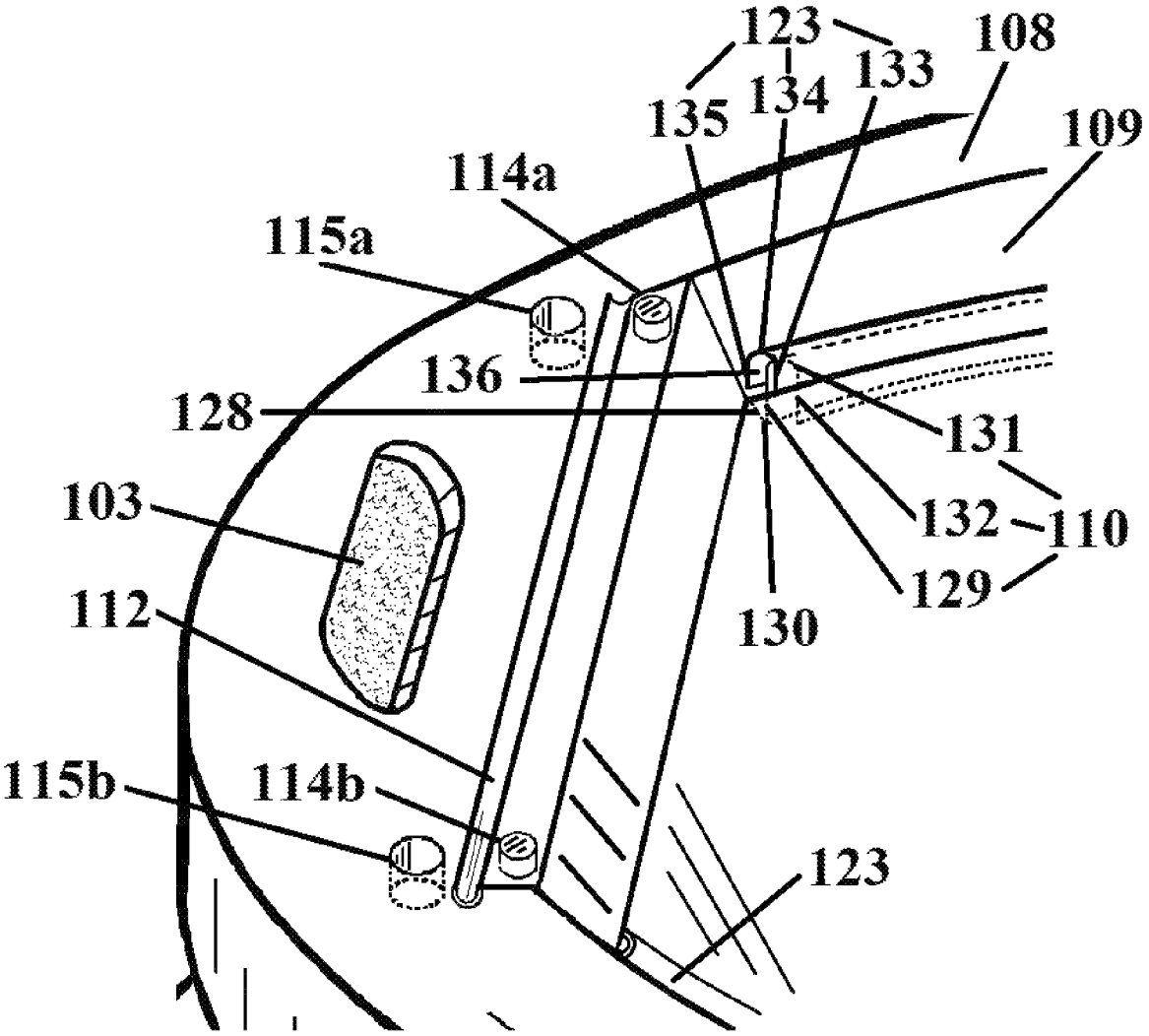
FIG. 1A is a partial perspective view, on a larger scale, of a portion of a container lid in FIG. 1.

FIG. 1A is a partial perspective view, on a larger scale, of a portion of a container lid in FIG. 1. In a preferred embodiment of the present invention, curved inside wall 109 is downwardly dependent from top transition surface 108, showing curved inside wall 109 and curved inside wall base extension 128 terminating marginally below the horizontal plane of inclined top surface 120. A portion of ridge rib outside wall 129 is upwardly dependent from the bottom base extension 128, such that base extension 128 and ridge rib outside wall 129, respectively, are separated by a narrow angle, thereby forming a V-shaped trough 130. Ridge rib outside wall 129 continues upwards forming ridge rib arch 131 cresting at approximately the mid-height of curved inside wall 109. The opposite side of ridge rib arch 131 turns downward forming ridge rib inside wall 132 terminating below trough 130, thereby completing the components comprising ridge rib 110 formed around the inside periphery of curved inside wall 109.

In another preferred embodiment of the present invention stiffening rib inside wall 133 is upwardly dependent from the periphery of inclined top surface 120 of hatch cover 116 forming stiffening rib arch 134, cresting above the height of ridge rib arch 131 and subsequently forming a downward dependent stiffening rib outside wall 135 from the opposite side of stiffening rib arch 134, thereby completing the components comprising stiffening rib 123 as first identified in FIG. 1.

Stiffening rib 123 has a channel 136 therein, dimensioned for mated fitment and frictional clamping over ridge rib 110, releasably locking hatch cover 116 in the closed position. The two opposing opened ends of mated stiffening rib 123 and ridge rib 110, terminate in close proximity too, and on either side of, articulating wall 117. The opposing sides of articulating wall 117 are in intimate contact with curved inside wall 109 and work in combination with mated ribs 123 and 110, creating a tight seal, reducing leaking of beverage 103 and mitigating heat loss from a hot beverage through the contact interfaces between the components of hatch cover 116 and curved inside wall 109 of brim mount 107. The lubricated properties of the plastic allows for repeated unlocking and locking between channel 136 and ridge rib 110 and the respective separation and realigning of the sides of articulating wall 117 with inside curved wall 109, as hatch cover 116 is rotated between the opened and closed positions for the purposes of dunking a confection or performing other actions on beverage 103.

Repeated locking and unlocking of hatch cover 116 is in direct contrasts to the lid/container 100/102 assembly, which, although semi-releasable, was not designed for repeated release and re-attachment, but rather to remain sealed for the duration of consumption of the beverage, reducing spills and heat loss. Consequently barristas add condiments and affix lids to beverage 103 filled containers 102 before handing them over to the customer. This helps explain why dunking a confection into a beverage is not widely practised when purchasing sealed fast food beverages and why confections, some of which are designed to be dunked before ingestion, such as a biscotti, are increasing unavailable for purchase.

Opposing twin posts 114*a* and 114*b* protrude from the top surface at opposite ends of rigid connecting panel 113. Twin cavities, 115*a* and 115*b*, are recessed within top transition surface 108, respectively, on the other side of hinge 112 opposite twin posts 114*a* and 114*b*, at opposing ends of hinge 112. Twin posts 114*a* and 114*b* have rounded surfaces and diameters which are slightly less than the radius of their base, and minutely less than the radius of twin cavities 115*a* and 115*b*. Twin posts 114*a* and 114*b* have a vertical height which is less than the depth of twin cavities 115*a* and 115*b*.

Twin posts 114*a* and 114*b* and twin cavities 115*a* and 115*b*, are respectively, equidistant from each other on either side of hinge 112, such that when hatch cover 116 is rotated 180 degrees about hinge 112, twin posts 114*a* and 114*b* are in registration directly above twin cavities 115*a* and 115*b*, thereby allowing twin posts 114*a* and 114*b* to be releasably frictionally seated into twin cavities 115*a* and 115*b* to secure hatch cover 116 in the opened position. This embodiment will be further discussed in FIGS. 3 and 3A.

Figure 2:
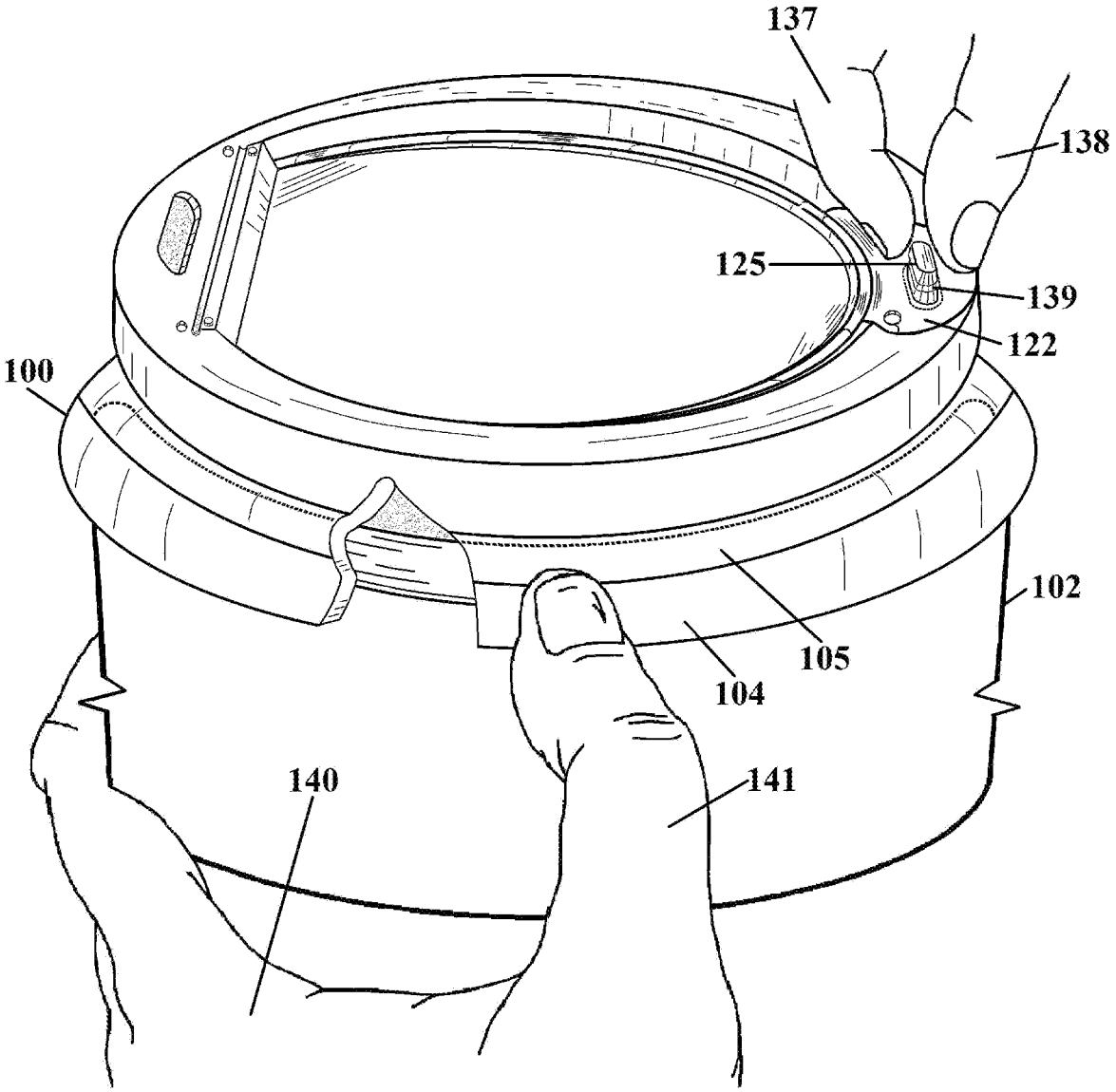
FIG. 2 is a perspective view showing a preferred embodiment of a container lid constructed in accordance with the principles of the present invention showing a hatch cover in the process of being opened and/or closed.

FIG. 2 is a perspective view of the present invention with hatch cover 116 (as seen in FIG. 1) in the closed position showing gripping post 125 in the grasp of index finger 137 and thumb 138 initiating the lifting and rotation of hatch cover 116 to its opened position shown in FIG. 3, or, alternatively, again referring to FIG. 3, rotating opened hatch cover 116 back to the closed position.

Typically, but not necessarily, gripping post 125 may include a gripping means defined as a mid horizontal circumferential notch 139, bisecting the circumference of gripping post 125 at mid-height to aid in grasping post 125.

While gripping post 125 is being lifted upward, opposing hand 140 is wrapped around container 102 (compressed for ease of illustration), with opposing thumb 141 extended to apply downward pressure to flanges 104 and 105 on lid 100. This positioning of hand 140 steadies container 102 and opposing thumb 141 holds lid 100 down as gripping post 125 is pulled upwards and sealable rib/channel 123/136 (as seen in FIG. 1A) are disengaged from frictional fitment with ridge rib 110 (as seen in FIG. 1A). This arrangement may change with handedness and repositioning of fingers and thumb.

Figure 2A:
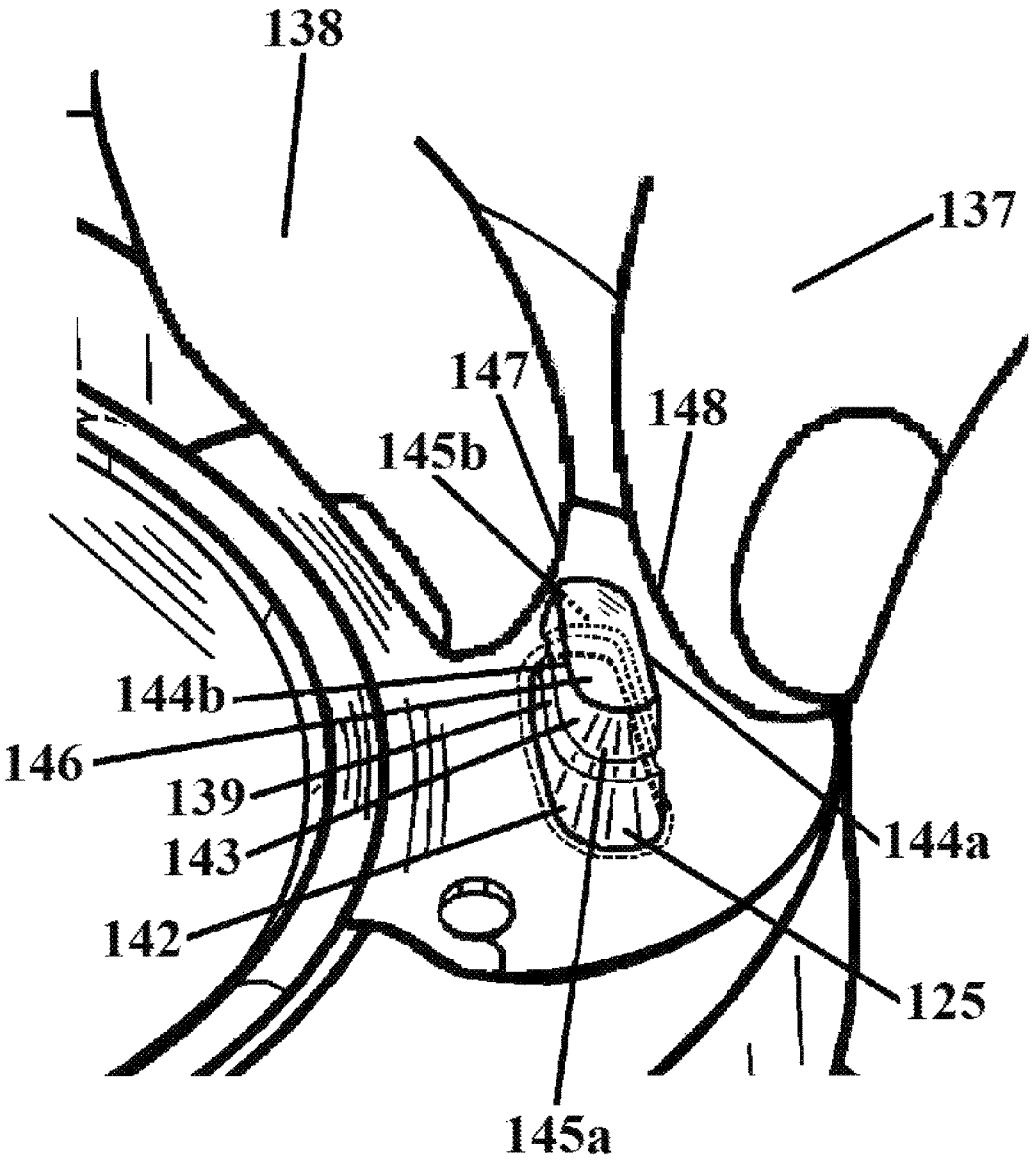
FIG. 2A is a partial perspective view, on a larger scale, of a portion of a container lid shown in FIG. 2.

FIG. 2A is a partial perspective view, on a larger scale, of a portion of a container lid 100 shown in FIG. 2 with hatch cover 116 in the closed position and mid notch 139 bisecting gripping post 125 at mid height forming a wider lower portion 142 and narrower upper portion 143, thereby creating a preferably upwards incline with opposed side walls 144*a* and 144*b*, respectively, proportionally wider than the opposed end walls 145*a* and 145*b*, and forming a horizontally flat top nose surface 146.

When grasping gripping post 125, index finger surface 147 and thumb surface 148, respectively, of index finger 137 and thumb 138, engage opposed end walls 145*a* and 145*b*, pulling gripping post 125 upwards and prying channel 136 free from frictional mated fitment to ridge rib 110 (as seen in FIG. 1A).

Figure 3:
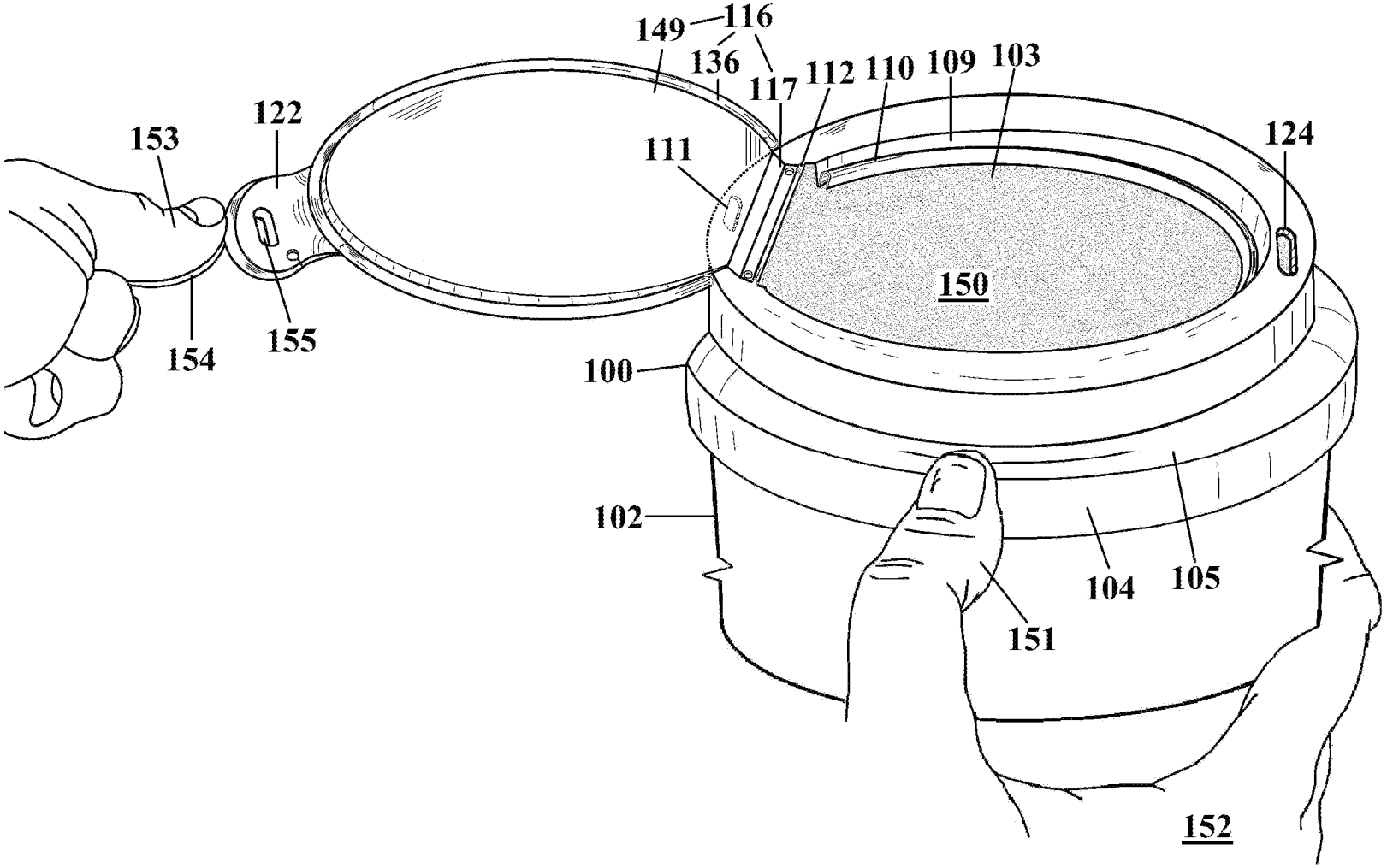
FIG. 3 is a perspective view showing a preferred embodiment of a container lid constructed in accordance with the principles of the present invention with a hatch cover in the opened position.

FIG. 3 is a perspective view of lid 100 of the present invention secured to container 102 (compressed for ease of illustration) showing the opening of hatch cover 116 progressing from FIGS. 2 and 2A rotating 180 degrees about hinge 112, thereby inverting articulating wall 117 and stiffening rib 123 showing its corresponding channel 136 facing upwards, and also inverting inclined top surface 120 (as seen in FIG. 1) thereby bringing the underside inclined bottom surface 149 to now also face upwards. The rotation of hatch cover 116 results in the creation of a centrally positioned mainly annular hatch opening 150 within curved inside wall 109 and ridge rib 110, for the purposes of dunking a confection or performing other actions on beverage 103 without necessitating the removal of lid 100 from container 102.

Hinge 112 enables hatch cover 116 to remain in a substantially horizontal configuration, thereby allowing the consumer to optionally disengage index finger 137 and thumb 138 from gripping post 125 and opposing hand 140 and thumb 141, respectively, from container 102 and flanges 104 and 105 (as seen in FIGS. 2 and 2A).

When hatch cover 116 is in the opened position, it conceals the primary drinking access port 111. However, secondary drinking access port 124 is now available since it is no longer concealed by arcuate tab 122. The consumer has the ability to dunk a confection into beverage 103 via hatch opening 150 while also enjoying beverage 103 through secondary drinking access port 124. Further, hatch opening 150 offers room for the consumer's nose and lip when tilting container 102 forward to send beverage 103 through secondary drinking access port 124.

In another embodiment of the present invention as described in FIG. 3, inclined bottom surface 149 is further defined by a low angle slant depending downwards from a higher elevation adjacent inverted arcuate tab 122 towards a lower elevation adjacent inverted articulating wall 117.

When the consumer wishes to re-close hatch cover 116 after dunking and consuming a confection or performing other functions through hatch opening 150; they do so by steadying lid 100 and container 102, respectively, with thumb 151 and hand 152 while using thumb 153 and index finger 154 to grip an edge of inverted arcuate tab 122, rotating hatch cover 116 upwards, 180 degrees in the reverse direction, thereby closing hatch opening 150. As hatch cover 116 is rotated, thumb 153 and index finger 154 may be repositioned, moving from grasping an edge of inverted arcuate tab 122 to grasping gripping post 125 for better leverage during the closing process. Gripping post 125 is also shown by its respective gripping post cavity 155 on the inverted underside of arcuate tab 122. Once hatch cover 116 is substantially horizontal above hatch opening 150, gentle downward finger pressure is applied to inclined top surface 120, thereby once again frictionally clamping channel 136 onto ridge rib 110 (as seen in FIG. 1A), and, at the same time, cooperatively realigning the sides of articulating wall 117 with curved inside wall 109, completing the resealing and locking of hatch cover 116 in the closed position. Articulating wall 117 and curved inside wall 109 are fixed in a generally stable position such that the closing of hatch cover 116 does not leak beverage 103 and interfere with the user discharging flowable contents through primary drinking access port 111.

This particular combination of hinge 112, articulating wall 117 and configured hatch cover 116 permits hatch cover 116 to be very conveniently opened and disengaged from the channel/rib 136/110 mating (as seen in FIG. 1A), and rotated to the second, opened position, and similarly closed, re-engaging channel/rib 136/110, such that opening and closing may be accomplished any number of times. Thus hatch cover 116 may be readily placed into its open position by the customer or barrista, or put into its closed position by the customer or barrista very quickly and reliably.

Figure 3A:
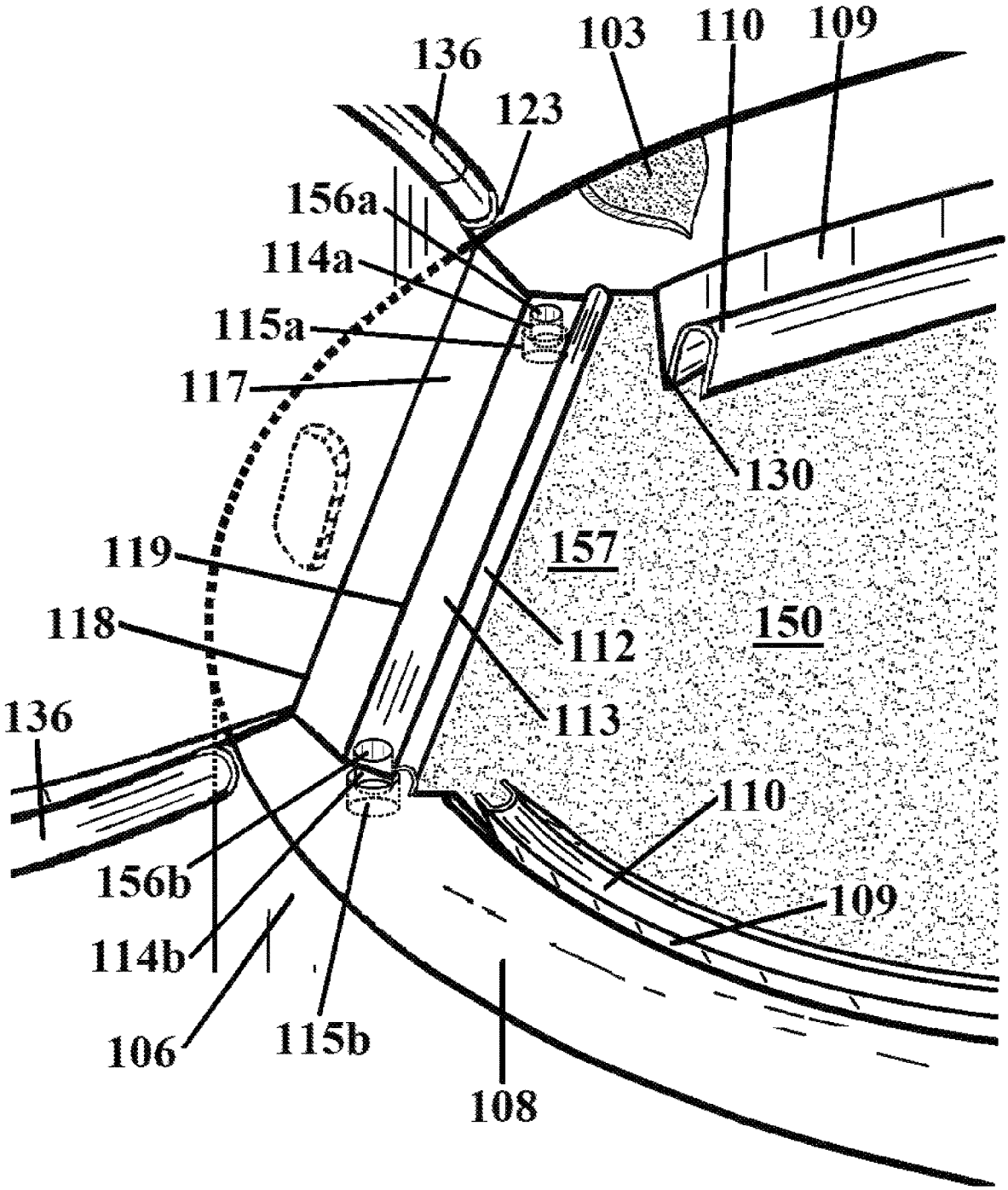
FIG. 3A is a partial perspective view, on a larger scale, of a portion of a container lid in FIG. 3 with a cut-away portion in the top of the lid exposing beverage below the brim mount.

FIG. 3A is a partial perspective view, on a larger scale, of a portion of FIG. 3 showing lid 100 with hatch cover 116 inverted in the opened position. In a further embodiment of the present invention the two opposing ends of inverted channel/ridge rib 136/123, terminate just beyond outside wall 106 and also clear top transition surface 108. As channel/ridge 136/123 does not rest on top transition surface 108, thereby allowing second articulating fold 119 and first articulating fold 118, respectively, on the top and bottom of inverted articulating wall 117 to bring articulating wall 117 and inverted rigid connecting panel 113 into intimate contact with top transition surface 108. Twin posts 114*a* and 114*b*, protruding from rigid connecting panel 113 (as seen in FIG. 1A), are inverted and in registration, respectively, above twin cavities 115*a* and 115*b* (as seen in FIG. 1A) due to their equidistant relationship on either side of hinge 112. Inverted twin posts 114*a* and 114*b* are also defined by their respective twin post cavities 156*a* and 156*b*, on the inverted surface of rigid connecting panel 113. Hatch cover 116 may be optionally, more permanently fixed in the opened position by frictionally inserting twin posts 114*a* and 114*b*, respectively, into twin cavities 115*a* and 115*b* with downward finger pressure, releasably locking hatch cover 116 in the opened position, thereby keeping hatch cover 116 remote from possible interference when accessing beverage 103 through hatch opening 150.

In another embodiment of the present invention curved inside wall 109 acts as an anti-splash/spill apron when hatch cover 116 is in the opened position by limiting splashing of beverage 103 occupying the area below top transition surface 108 as seen in cut-away and between outside wall 106 and the opposite side of curved inside wall 109, from reaching hatch opening 150 and splashing over top transition surface 108 and possibly making contact with the consumer.

Conversely, the inside surface of curved inside wall 109, substantially around the periphery of hatch opening 150, in conjunction with ridge rib 110 (as seen in FIG. 1A), limits beverage 103 within hatch opening 150 area from splashing onto, and spilling beyond, top transition surface 108, possibly making contact with the consumer. Trough 130 is slanted downwards on either side towards its opened ends and acts as a sump collecting any splashed beverage 103 arising from hatch opening 150 and flowing over ridge rib 110, hitting inside surface of curved inside wall 109, cascading vertically down wall 109 into trough 130. Trough 130 conveys collected beverage 103 out its opposing open ends into space 157, directly below hinge 112, thereby returning collected beverage 103 back into container 102.

Figure 4:
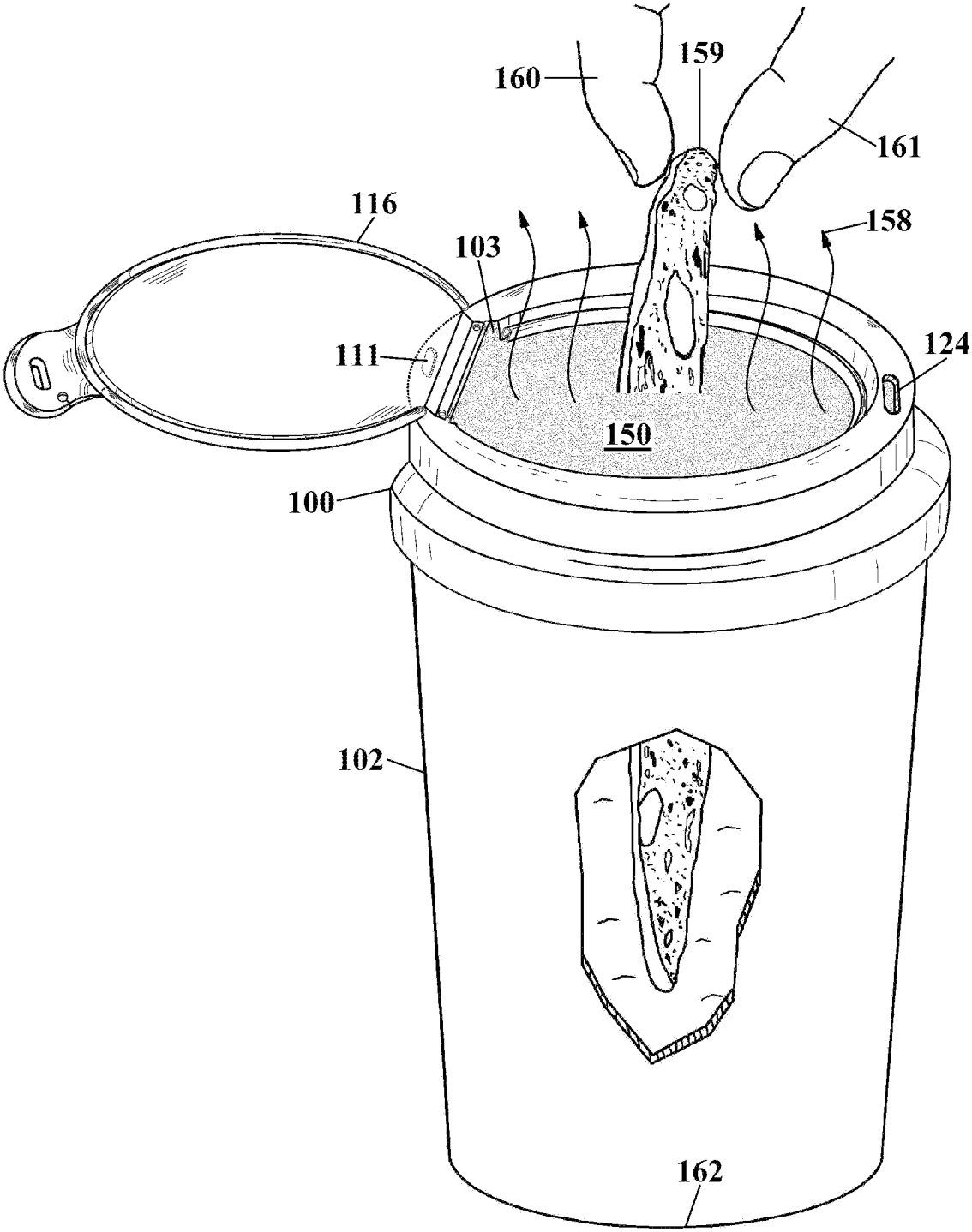
FIG. 4 is a perspective view showing a preferred embodiment of a container lid constructed in accordance with the principles of the present invention where a consumer is dunking a confection into a beverage through a hatch opening with a cut-away in the side wall of the container showing a portion of a confection, such as a biscotti, immersed in the beverage.

FIG. 4 is a perspective view of lid 100 of the present invention with hatch cover 116 in the opened position (as seen in FIG. 3) exposing hatch opening 150 with a hot beverage 103 therein, with steam and aroma, as indicated by heat arrows 158, escaping upwardly therefrom container 102.

In a preferred embodiment of the present invention hatch opening 150 is substantially large enough to allow for the unencumbered immersing of a confection such as a biscotti 159 or the like, through hatch opening 150 into a beverage 103 (hot or cold), to a desired depth and time in a safe manner without the necessity of first removing lid 100 from container 102.

A confection 159, such as a biscotti, may be gripped for dunking between the ends of a person's index finger 160 and thumb 161, simultaneously engaging the sides of confection 159. The objective is to hold confection 159, keeping index finger 160 and thumb 161 at a safe distance from hot beverage 103. Confection 159 is dunked into beverage 103 to a suitable depth to soften, but not disintegrate, such that only that portion submerged will be enjoyably consumed. A cut-away in the side of container 102 is for illustrative purposes only; showing confection 159 dunked into beverage 103 and is not meant to represent the depth a confection 159 is dunked as this will change from person to person.

As mentioned under the background section, a confection 159, such as a biscotti for example, must be retrieved from beverage 103 when it has been suitably softened for consumption and not allowed to remain submerged too long for fear it will break apart and drop to the container bottom 162, and is no longer easily retrieved for consumption. As the size of bite portioned from confection 159 and ingested will vary amongst consumers, consequently the depth a confection 159 may be dunked will also vary. At some point after repeated dunking, and subsequent consumption of confection 159, index finger 160 and thumb 161 may be left holding a small remaining piece of confection 159 which cannot be suitably dunked without index finger 160 and thumb 161 contacting beverage 103. The consumer has options to deal with the remaining dried portion of confection 159. The consumer may choose to consume the remaining dry portion of confection 159 with a sip of beverage 103 from either drinking access ports 124 or 111, when hatch cover 116 is respectively in the opened or closed position. Alternatively, the consumer may attempt to dunk the next to last piece of confection 159 into beverage 103, waiting a bit longer before retrieving, risking its disintegration and break up, or successfully retrieving the remaining portions intact, infused with beverage 103, allowing capillary action to migrate beverage 103 throughout the remaining portion of confection 159, softening it for a more enjoyable final ending.

The purpose of dunking a confection 159 such as a biscotti for example into beverage 103 is to enhance the beverage 103 drinking experience by combining beverage 103 with a confection 159. Selecting a biscotti for example as the confection 159 for dunking into beverage 103 (hot or cold) is not novel, however, a biscotti and similar long narrow confections 159 are often ignored when ordering beverages 103 in disposable beverage containers 102. As one of many optional confections 159, a biscotti has become more and more conspicuous by its absence at takeout café establishments, despite the fact that this confection 159 is intended, by design and history, to be specifically consumed infused with a beverage 103 and eaten on the go. To enjoy the experience of a confection 159 such as a biscotti with a hot beverage 103 for example, and make this combo attractive to the on-the-go beverage consumer, a beverage 103 must be easily and safely accessed in an expeditious manner, while lid 100 remains sealed on the rolled rim 101 (see FIG. 1) of container 102. Once confection 159 is consumed, the consumer may continue drinking beverage 103 with hatch cover 116 opened, through the secondary drinking access port 124. Conversely, hatch cover 116 may be returned to its closed position and locked in place allowing the consumer to continue sipping beverage 103 from the primary drinking access port 111.

Hatch cover 116 offers a means for dunking a confection 159 such as a biscotti for example or other similar shaped biscuit into beverage 103 in a leisurely fashion without the necessity and risk of removing and/or reattaching lid 100 to rolled rim 101 of container 102 prior to, and following, the dunking process.

Figure 5:
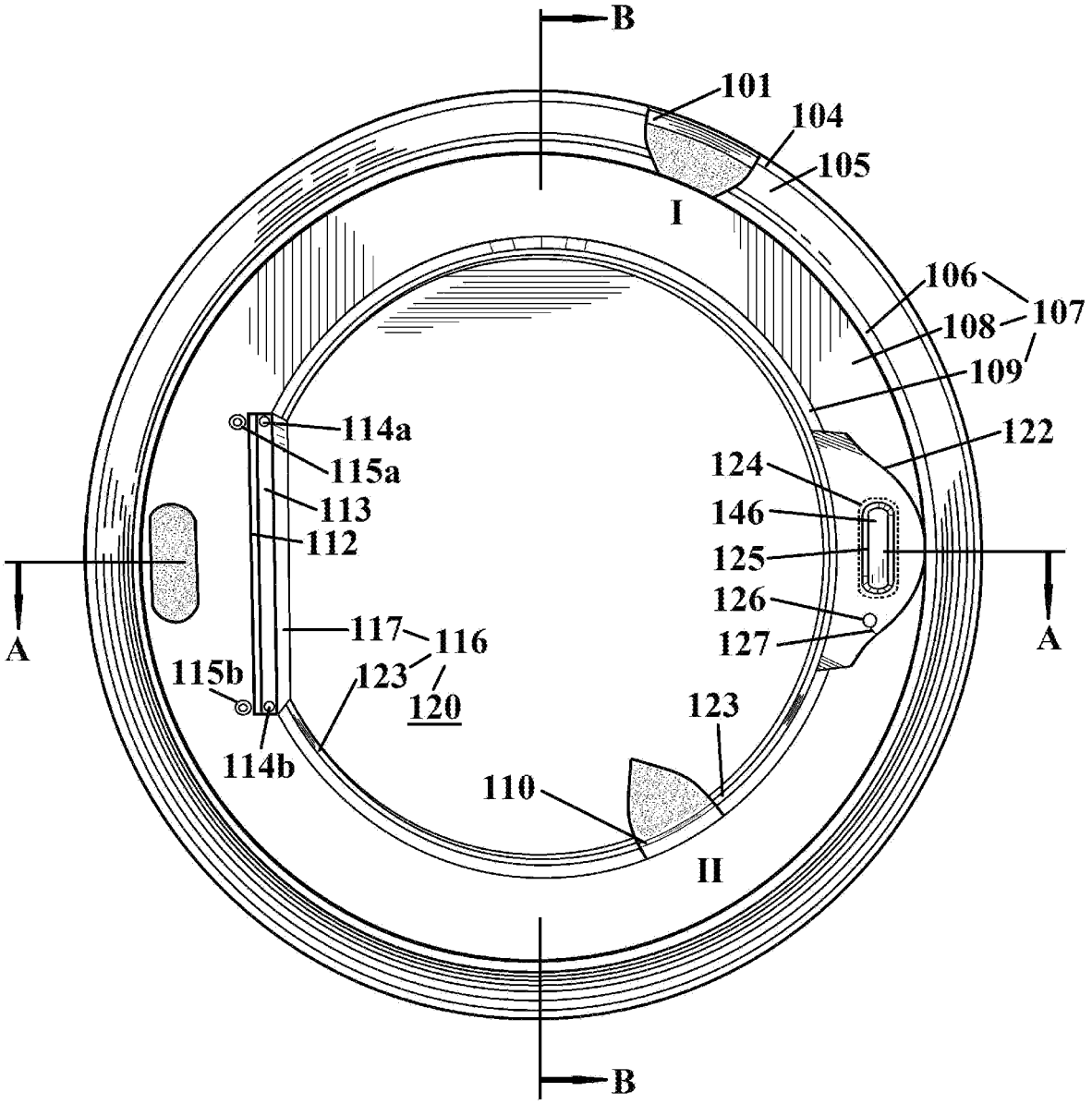
FIG. 5 is a top view of a container lid with the hatch cover in the closed position with a first cut-away (I) portion in the top of the lid showing the engagement of the rim of the lid to the rolled rim of the container. A second cut-away (II) portion in the top of the lid shows the frictional fitment of the stiffening rib of the hatch cover onto the ridge rib.

FIG. 5 is a top view of lid 100 (as seen in FIG. 1) with hatch cover 116 in the closed position (as seen in FIG. 1) showing the spatial relationship of several embodiments of the present invention. Proceeding from right to left along line A-A, lid 100 shows a first cut-away (I) portion exposing the cooperative engaging of continuous flange 104 and transition flange 105, sealingly engaged to rolled rim 101 of container 102 (as seen in FIG. 1). Transition flange 105 is inwardly dependent inclining upwards at a low angle slant from the top of continuous flange 104 to the base of outside wall 106, which itself is upwardly dependent from transition flange 105, terminating at top transition surface 108. Curved inside wall 109 is downwardly dependent from top transition surface 108. Components 106, 108, and 109 comprise brim mount 107. Curved inside wall 109 is substantially vertically downwardly dependent from top transition surface 108. Lid 100 shows a second cut-away (II) portion exposing the mating of stiffening rib/channel 123/136 around the periphery of hatch cover 116, onto ridge rib 110 (as seen in FIG. 1A). Arcuate tab 122 extends from hatch cover 116 onto top transition surface 108, concealing secondary drinking access port 124 and also showing top nose surface 146 (as seen in FIG. 2A) of gripping post 125 and adjacent string guide hole 126 and string entry slit 127.

At the opposite end of hatch cover 116, distal from arcuate tab 122, articulating wall 117 is substantially vertically upwardly dependent from inclined top surface 120 of hatch cover 116 connecting to rigid connecting panel 113 which subsequently connects to hinge 112. The tops of twin posts 114*a* and 114*b* (as seen in FIG. 1A), at opposite ends of rigid connecting panel 113, are shown to be equidistant, respectively, from twin cavities 115*a* and 115*b* (as seen in FIG. 1A) located at either end on the opposite side of hinge 112.

Figure 5A:
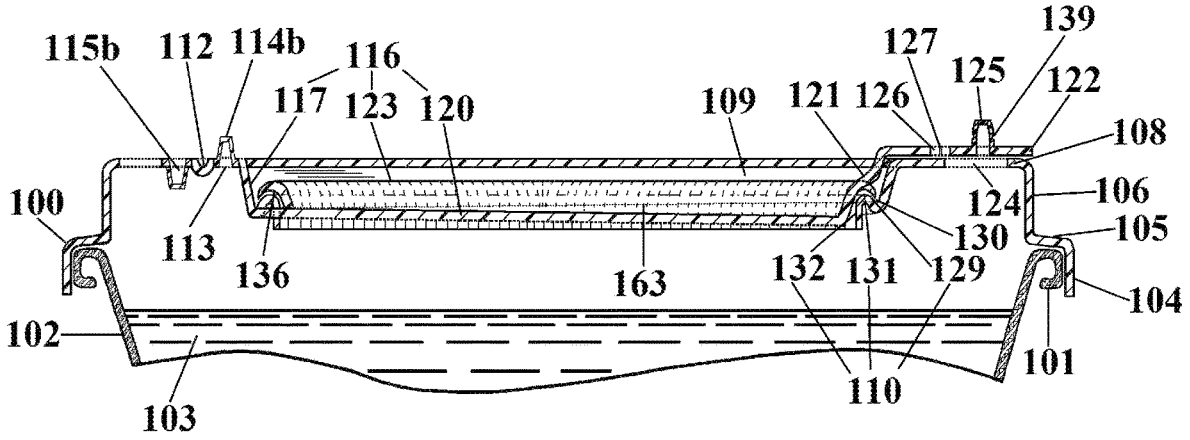
FIG. 5A is a cross-sectional view taken substantially along line A-A in FIG. 5, showing a container lid mounted on a beverage filled container.

FIG. 5A is a partial cross-sectional view of lid 100 of the present invention with hatch cover 116 in the closed position taken substantially along the line A-A in FIG. 5 with a partial view of beverage 103 filled container 102 (partially shown for ease of illustration). Continuous flange 104 and transition flange 105 are reversibly attached to rolled rim 101. Outside wall 106 is upwardly dependent from transition flange 105 to top transition surface 108. Curved inside wall 109 is downwardly dependent from top transition surface 108, at a steep angle to form one side of trough 130. The ridge rib outside wall 129 forms the opposite side of trough 130, depending upward forming ridge rib arch 131. The opposite side of ridge rib arch 131 turns downward forming ridge rib inside wall 132 terminating below the base of both trough 130 and inclined slanted top surface 120, thereby comprising the components of ridge rib 110 formed around the inside periphery of curved inside wall 109.

Arcuate tab 122 rests over top transition surface 108 covering the secondary drinking access port 124. Gripping post 125 protrudes vertically upwards from the surface of arcuate tab 122 and discloses mid notch 139 to assist grasping gripping post 125. Adjacent gripping post 125 is string guide hole 126 with two parallel solid vertical lines through the centre signifying string entry slit 127. Arcuate tab 122 is upwardly dependent from inclined top surface 120 of hatch cover 116 via undulated transition gradient 121 conforming to, and riding over, curved inside wall 109. Trough 130 has a higher elevation adjacent undulated transition gradient 121 forming trough slope 163 slanting at a low angle to a lower elevation adjacent articulating wall 117, allowing trough 130 to collect splashed beverage 103 and act as a sump, conveying collected beverage 103 down trough slope 163 to drain back into container 102 where both opposing ends of trough 130 terminate adjacent articulating wall 117.

Stiffening rib/channel 123/136, partially annular around the perimeter of inclined top surface 120 of hatch cover 116, is frictionally fittingly mated onto ridge rib 110 thereby locking hatch cover 116 in the closed position. Post **114*b* (and also post 114*a* not shown in cross-section A-A) is upwardly dependent from the surface of rigid connecting panel 113 on one side of hinge 112 and cavity 115*b* (and also cavity 115*a* not shown in cross-section A-A) is downwardly dependent from top transition surface 108 on the opposite side of hinge 112, whereby post 114*b* and cavity 115*b* (and also post 114*a* and cavity 115*a* not shown) are equidistant on either side of hinge 112. Adjacent cavity 115*b* is primary drinking access port 111**.

Figure 5B:
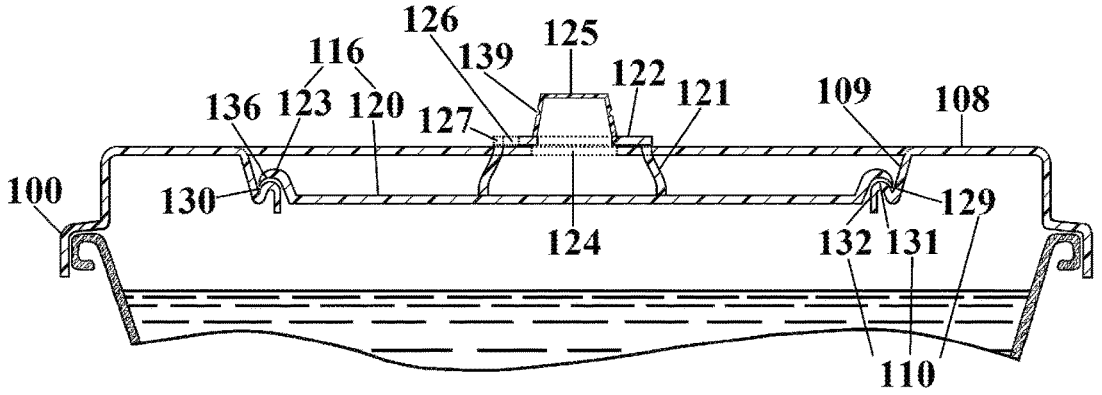
FIG. 5B is a cross-sectional view taken substantially along line B-B in FIG. 5 showing another view of a container lid mounted on a beverage filled container.

FIG. 5B is a partial cross-sectional view of lid 100 of the present invention taken substantially along line B-B in FIG. 5 with hatch cover 116 in the closed position showing curved inside wall 109 and ridge rib 110 comprised of ridge rib outside wall 129, ridge rib arch 131 and ridge rib inside wall 132 with interposed trough 130. Ridge rib inside wall 132 (as seen in FIGS. 1A and 5A) is downwardly depend from ridge rib arch 131 and terminates below inclined top surface 120. Stiffening rib/channel 123/136 (as seen in FIGS. 1A and 5A) is frictionally mated to ridge rib 110, releasably clamping hatch cover 116 in the closed position. Articulating wall 117 is not visible in cross-section B-B.

Arcuate tab 122 is centrally positioned, resting on top transition surface 108 directly over secondary drinking access port 124. Arcuate tab 122 is upwardly dependent via undulated transition gradient 121 from inclined top surface 120 of hatch cover 116. Protruding upwards from the surface of arcuate tab 122 is gripping post 125 with mid notch 139 to assists grasping gripping post 125 to lift hatch cover 116 from the closed position in FIGS. 1 and 5, to the open position in FIGS. 3 and 6. Adjacent gripping post 125 is string guide hole 126 and string entry slit 127 for accessing string guide hole 126.

Figure 6:
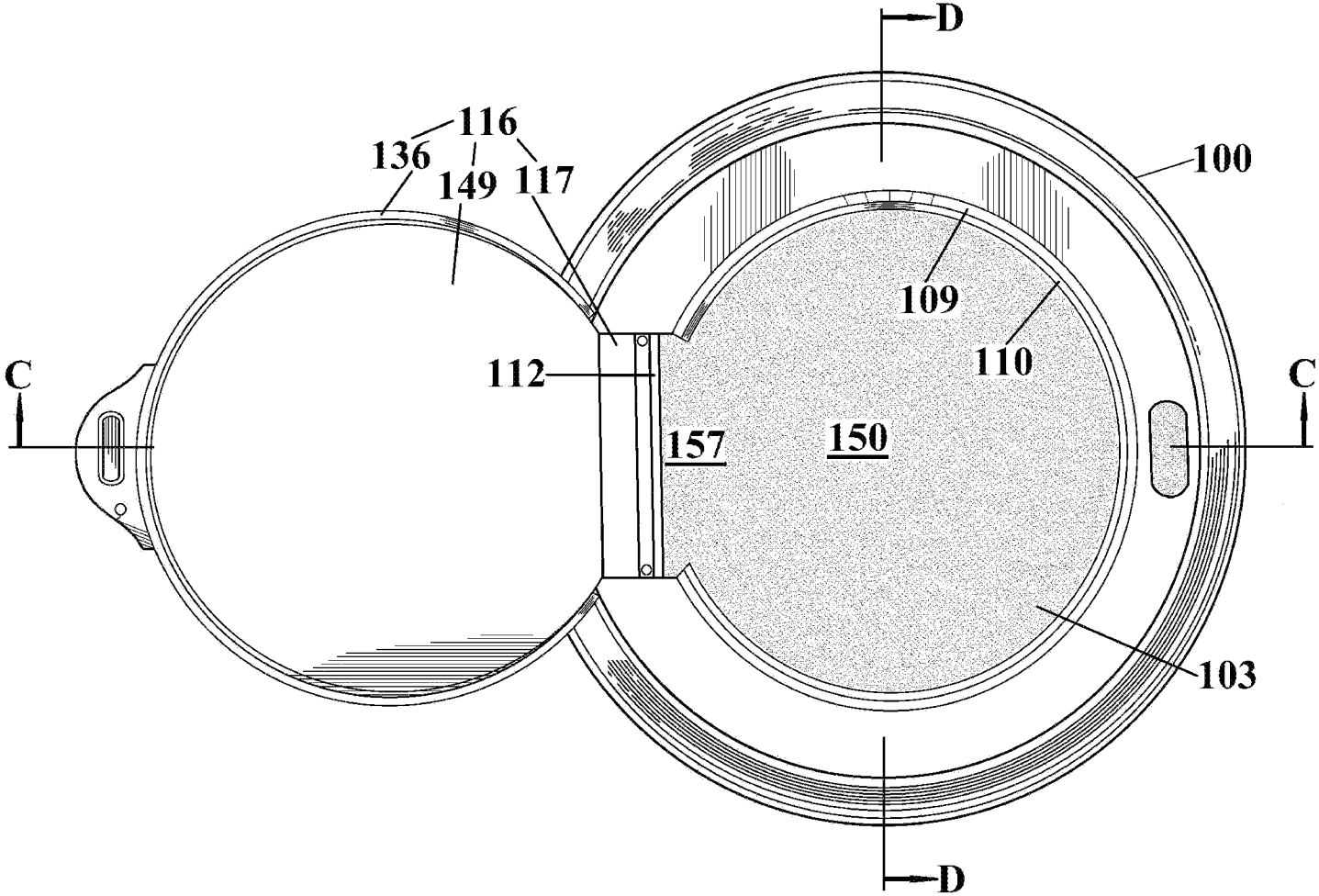
FIG. 6 is a top view of a container lid with a hatch cover in the opened position.

FIG. 6 is a top view of lid 100 of the present invention with hatch cover 116 rotated 180 degrees about hinge 112 into a substantially horizontal inverted opened position as seen earlier in FIG. 3, thereby creating hatch opening 150 bordered by curved inside wall 109 and ridge rib 110. This top view illustrates the substantial area available in hatch opening 150 for unencumbered and easy access to beverage 103 through the top of lid 100 for the purposes of dunking a confection 157 such as a biscotti and the like (as seen in FIG. 4) or performing other actions on beverage 103 without the necessity and risks of removing lid 100 from container 102. Hatch cover 116 is comprised of inclined bottom surface 149, articulating wall 117 and inverted channel/stiffening rib 136/123. Space 157 is created when articulating wall 117 is rotated 180.

Figure 6A:
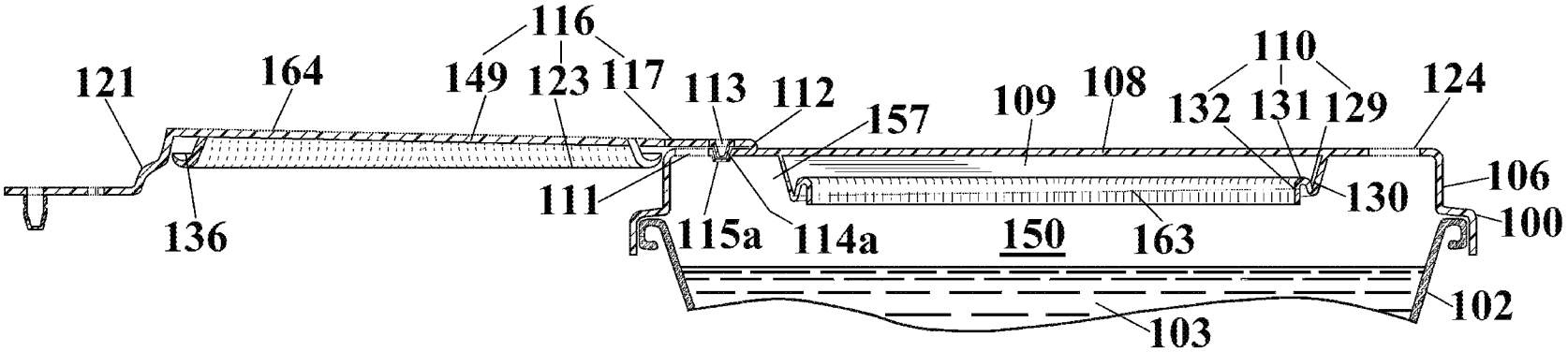
FIG. 6A is a cross-sectional view taken substantially along line C-C in FIG. 6 showing a container lid with a hatch cover in the opened position.

FIG. 6A is a partial cross-sectional view of lid 100 of the present invention with hatch cover 116 in the opened position taken substantially along line C-C of FIG. 6. Container 102, with beverage 103, is partially shown for ease of illustration. The rotation of hatch cover 116 to the opened position creates hatch opening 150 in the top of lid 100 for accessing beverage 103, and also conceals primary drinking access port 111 thereby simultaneously making secondary drinking access port 124 available to the consumer for retrieving beverage 103.

Curved inside wall 109 is downwardly dependent from top transition surface 108 creating one side of trough 130. Ridge rib outside wall 129 is upwardly dependent from trough 130, thereby completing the V-shaped sides of trough 130. Ridge rib outside wall 129 continues upwards forming ridge rib arch 131. Ridge rib inside wall 132 is downwardly dependent from the opposite side of ridge rib arch 131 terminating with a flat base below the base of trough 130. Trough 130 is further defined by trough slope 163 sloping at a low angel downwards from a higher elevation near secondary drinking access port 124 towards a lower elevation adjacent space 157 created when articulating wall 117 is rotated with hatch cover 116. The combined opposing terminations of curved inside wall 109, trough 130 and ridge rib 110 end at space 157 created when articulating wall 117 is rotated 180 degrees, providing opposing outlets allowing the sump action of trough 130 to convey any splashed beverage 103, arising in hatch opening 150 and deflected to collect in trough 130, to be drained and returned through the open terminal ends of trough 130 back into container 102.

Open hatch cover 116 discloses the opposing terminal ends of inverted channel/stiffening rib 136/123 (as seen in FIGS. 3 and 5A) to be just beyond contact with top transition surface 108 and outside wall 106, thereby enabling hinge 112 to rotate substantially 180 degrees bringing inverted hatch cover 116, inverted articulating wall 117, and inverted rigid connecting panel 113 into a substantially horizontal plane and into intimate contact with top transition surface 108. Post **114*a* (and also post 114*b* not shown in cross-section C-C), is in registration above cavity 115*a* (and also post 114*b* is in registration above cavity 115*b* not shown in cross-section C-C), and may be frictionally fitted into cavity 115*a* (together with post 114*b* into cavity 115*b*) with gentle downward finger pressure to releasably lock hatch cover 116 in the opened position, reducing any possible interference of hatch cover 116 which might impact on any activities involving hatch opening 150 and beverage 103**.

The inverted inclined bottom surface 149 of hatch cover 116 has a higher elevation adjacent undulated transition gradient 121 and a lower elevation adjacent inverted articulating wall 117, thereby creating a gentle downward bottom slope 164 whereby an organic flavoured infusion pouch (such as a tea bag for example) may be retrieved from beverage 103 in container 102 and rested on the inverted inclined bottom surface 149 of hatch cover 116. Residual infused beverage, retained in the pouch, may then drain down bottom slope 164 passing over inverted articulating wall 117, inverted rigid connecting panel 113 and rotated hinge 112, flowing into space 157 and hatch opening 150, back into beverage 103 in container 102. The functionality of inverted inclined bottom surface 149 of hatch cover 116 will be further discussed under FIG. 13.

Figure 6B:
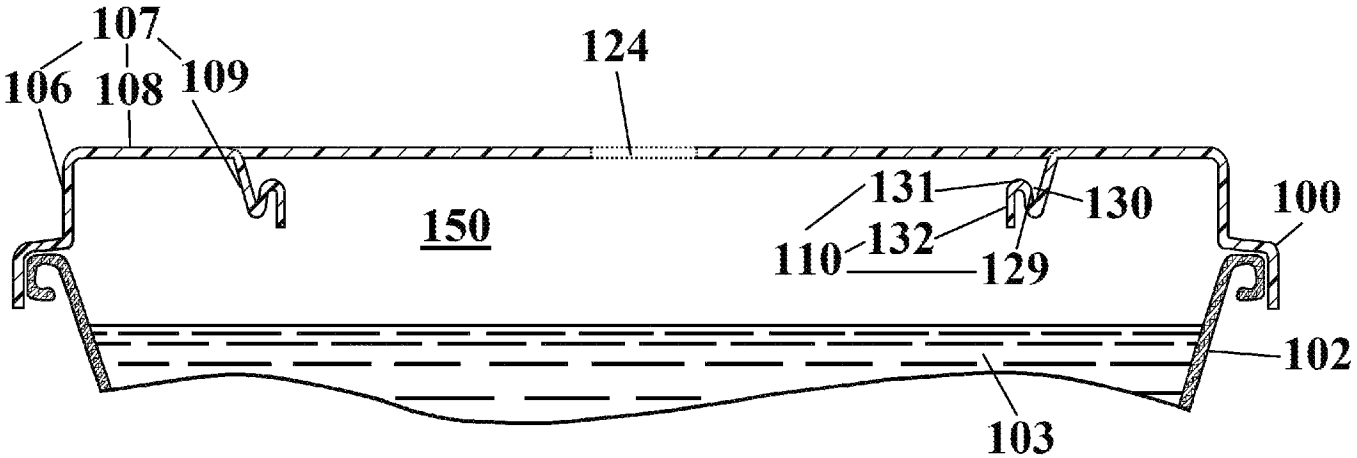
FIG. 6B is a cross-sectional view taken substantially along line D-D in FIG. 6 showing another view of a container lid with a hatch cover in the opened position.

FIG. 6B is a partial cross-sectional view of lid 100 of the present invention with hatch cover 116 (not shown) in the open position taken substantially along line D-D of FIG. 6. When hatch cover 116 is in the opened position a hatch opening 150 is created exposing the surface area of beverage 103 whereby movement of container 102 (partially shown for ease of illustration) may cause beverage 103 to be agitated and splash upwards from the beverage surface through hatch opening 150 onto the top transition surface 108 and possibly spill onto the consumer. To mitigate splashing from hatch opening 150, ridge rib 110 acts, in conjunction with curved inside wall 109, respectively, as primary and secondary anti-splash/spill aprons. Any splashed beverage 103 arising from hatch opening 150 may first come in contact with downwardly dependent ridge rib inside wall 132 and be deflected back into hatch opening 150 and container 102. However, splashed beverage 103 which passes over ridge rib arch 131 may either make contact with curved inside wall 109 and cascade vertically downward into trough 130 or land directly in trough 130, and be conveyed through sump action down trough slope 163 (as seen in FIG. 6A) towards either, or both terminated open ends of trough 130, draining collected beverage 103 into space 157 back through hatch opening 150 into container 102.

Additionally, the opposite side of curved inside wall 109 also acts as an anti-splash spill apron deflecting splashing arising from the surface of beverage 103 occupying the area circumscribing the space directly below brim mount 107 comprised of the opposite side of curved inside wall 109, the underside of top transition surface 108, and the interior side of outside wall 106, providing containment of any splashed beverage within this area, restricting it from reaching hatch opening 150. The opposite side wall of curved inside wall 109 also restricts beverage 103 from splashing and spilling beyond hatch opening 150 when drinking from secondary drinking access port 124 as beverage container 102 is tilted.

Figure 7:
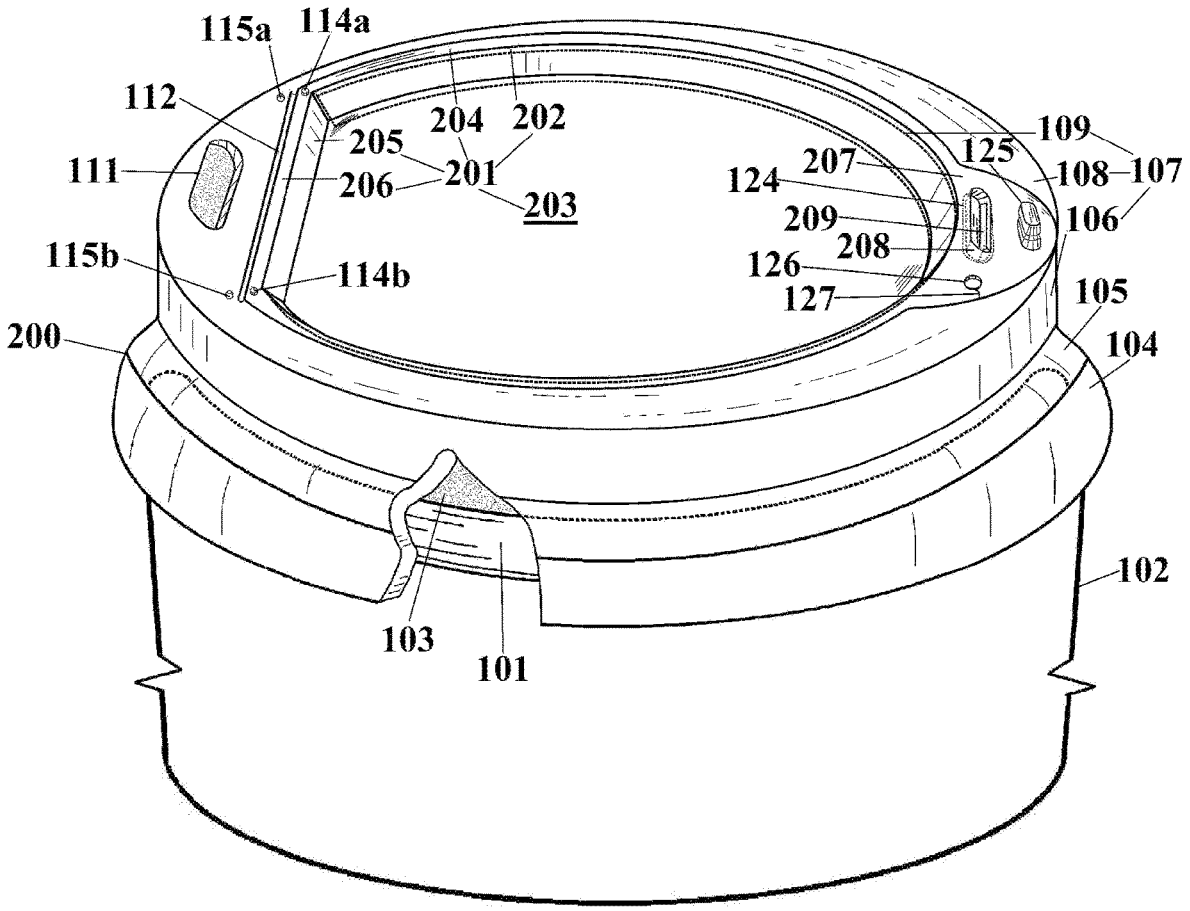
FIG. 7 is a perspective view of an alternative container lid compared with the container lid shown in FIG. 1, constructed in accordance with the principles of the present invention, shaped and sized to fit over a container with a portion of the lid cut-away to expose the engagement of the rim of the lid to the rolled rim of the container.

FIG. 7 is a perspective view of an alternative container lid 200 different from lid 100 shown in FIG. 1, constructed in accordance with the principles of the present invention for accessing beverage 103 without the need to first remove lid 200. Lid 200 includes many of the embodiments described in FIG. 1 regarding dome shape, circumferential outer continuous flange 104 and transition flange 105. Flanges 104 and 105 work together, clamping onto rolled rim 101 (see cut-away) reversibly attaching lid 200 onto container 102 (compressed for ease of illustration), reversibly securably sealing container 102. Lid 200 also discloses a first elevated planar region, brim mount 107, comprised of outside wall 106, upwardly dependent from transition flange 105, top surface 108, inwardly dependent from outside wall 106 and curved inside wall 109, downwardly dependent from top transition surface 108. Top transition surface 108 also discloses a primary drinking access port 111 and secondary drinking access port 124, respectively, deposed on opposite ends of brim mount 107, die cut into top transition surface 108.

In another preferred embodiment of the present invention, as shown in FIGS. 7, 7A, 8, 9, 9A, 9B, 10, 10A, 10B, 11, 11A, 11B, alternative lid 200 has an enclosed, recessed, centrally positioned flexibly integrated mainly annular reclosable fold-back hatch cover 201, forming a second recessed substantially planar region to accommodate the lip and nose of the consumer when the consumer is tilting container 102 and drinking from the primary drinking access port 111.

Enclosed hatch cover 201 is defined as being enclosed due to a mainly annular continuous curved peripheral wall 202 upwardly dependent from the perimeter of enclosed inclined top surface 203, distinguishable from inclined top surface 120 in FIG. 1 which is further defined by a peripheral stiffening rib 123. Continuous curved peripheral wall 202 has a wider circumference at the top and narrower circumference at the base creating a tapered wall, shaped and sized to engage the periphery of hatch opening and curved inside wall 109, when enclosed hatch cover 201 is in the closed position. Outwardly dependent from the top of continuous curved peripheral wall 202 is a mainly annular horizontally planar peripheral lip 204 in intimate contact with top transition surface 108 in a sealed fashion when enclosed hatch cover 201 is in the closed position. The opposing terminal ends of continuous curved peripheral wall 202 connects, respectively, to the opposing sides of a substantially vertical rigid transition wall 205, which depends upward from enclosed inclined top surface 203.

In a preferred embodiment of the present invention lip 204 forms an integrated planar rigid transition panel 206, interposed between hinge 112 and vertical rigid transition wall 205. Twin posts 114*a* and 114*b*, protrude vertically upwards from the surface at opposite ends of integrated planar rigid transition panel 206, Twin cavities 115*a* and 115*b*, are recessed within top transition surface 108, respectively, at opposing ends of hinge 112 and diametrically opposite twin posts 114*a* and 114*b* on the opposite side of hinge 112. Twin posts 114*a* and 114*b* and twin cavities 115*a* and 115*b*, respectively, are equidistant from each other on either side of hinge 112.

In another embodiment of the present invention, lip 202 depends outward forming an outwardly extending integrated planar arcuate tab 207 covering secondary drinking access port 124 and terminating where outside wall 106 is downwardly dependent from top transition surface 108. Integrated arcuate tab 207 has a die-cut string guide hole 126 and an adjacent die-cut string entry slit 127 ruptured from the edge of integrated arcuate tab 207 with a further centrally positioned gripping post 125 (as seen also in FIG. 1) protruding vertically from the top surface of integrated arcuate tab 207.

Enclosed hatch cover 201 is retained in the closed position through continuous curved peripheral wall 202 contoured to be frictionally seated within the contour of curved inside wall 109 which is also tapered with a larger upper circumference and smaller lower circumference, both circumferences dimensionally larger than the upper and lower circumferences of continuous curved peripheral wall 202. Enclosed hatch cover 201 is further releasably locked in the closed position via a downstanding vertical snap-fitting post 208 protruding vertically downward from the underside of integrated arcuate tab 207, releasably snapping into secondary drinking access port 124, sealing enclosed hatch cover 201 over the hatch opening. Downstanding post 208 has a corresponding downstanding post cavity 209 in the top surface of integrated arcuate tab 207.

As mentioned under FIG. 1A, the lubricated properties of the plastic also benefit lid 200, allowing enclosed hatch cover 201 to move repeatedly and easily between closed and opened positions to access beverage 103 in container 102 for dunking or other functions, avoiding the difficulty and risks associated with removing lid 200 from the rolled rim 101 of the container 102. Downstanding post 208 snap fitted into secondary drinking access port 124 together with the frictional mating of continuous curved peripheral wall 202 with curved inside wall 109 combine to releasably retain enclosed hatch cover 201 in the closed position but may be easily disengaged to the opened position and back a number of times.

Figure 7A:
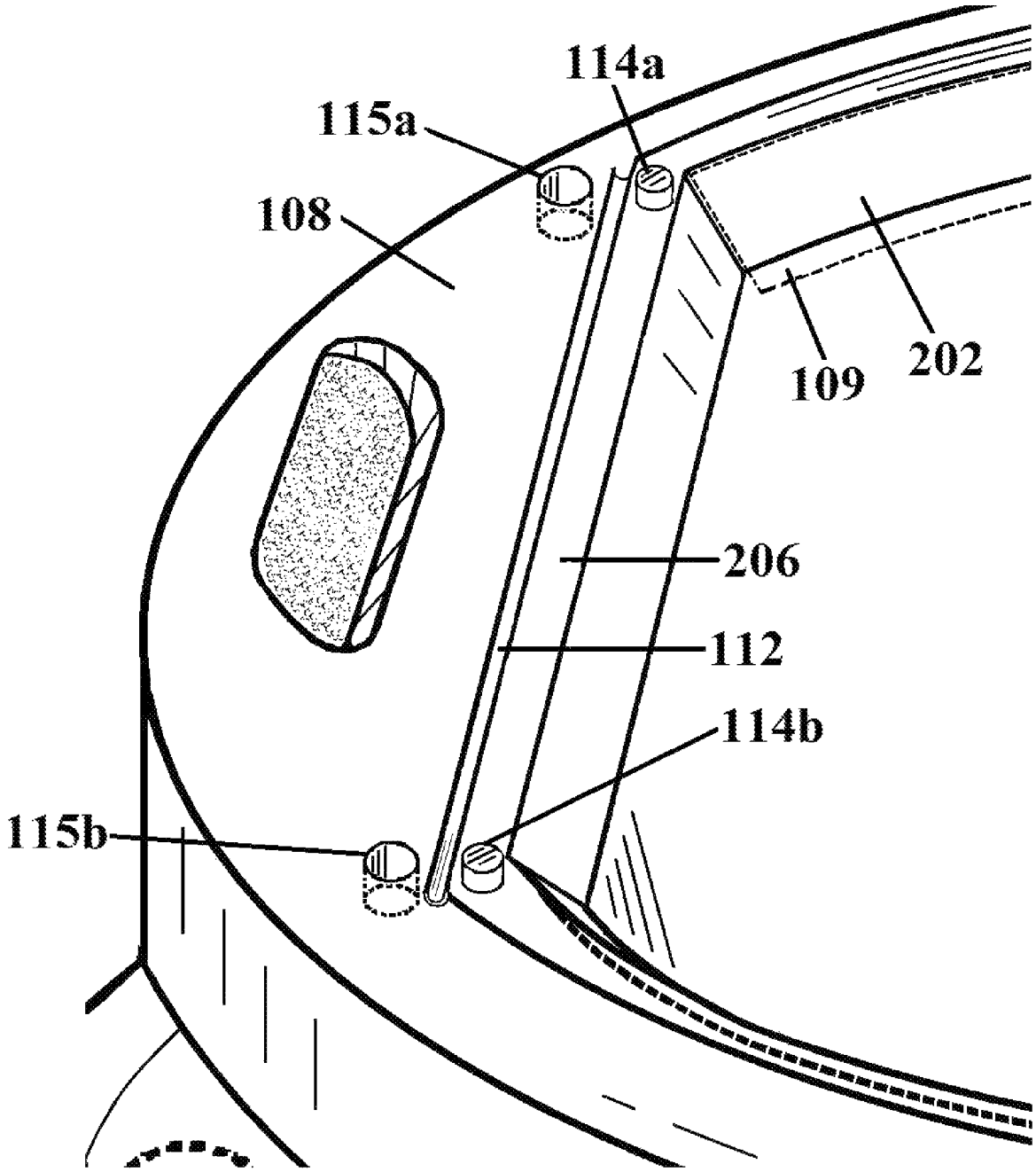
FIG. 7A is a partial perspective view, on a larger scale, of a portion of the alternative container lid shown in FIG. 7.

FIG. 7A is a partial perspective view, on a larger scale, of a portion of FIG. 7. In a further embodiment of the present invention twin posts 114*a* and 114*b* protrude vertically upward at opposing ends of integrated transition panel 206. Twin cavities 115*a* and 115*b* are recessed in top transition surface 108 at opposing ends of hinge 112 directly opposite corresponding posts 114*a* and 114*b*. Twin posts 114*a* and 114*b* have rounded upper surfaces and diameters which are slightly less than the radius of their base, and minutely less than the radius of twin cavities 115*a* and 115*b*. Twin posts 114*a* and 114*b* have a vertical height which is less than the depth of twin cavities 115*a* and 115*b*.

Twin posts 114*a* and 114*b* and twin cavities 115*a* and 115*b*, are respectively, equidistant from hinge 112, such that when enclosed hatch cover 201 is rotated 180 degrees about hinge 112, twin posts 114*a* and 114*b* are in registration directly above twin cavities 115*a* and 115*b*, thereby allowing twin posts 114*a* and 114*b* to be releasably frictionally seated into twin cavities 115*a* and 115*b* to secure enclosed hatch cover 201 in the opened position. Curved inside wall 109 is also shown in intimate contact with continuous curved peripheral wall 202.

Figure 8:
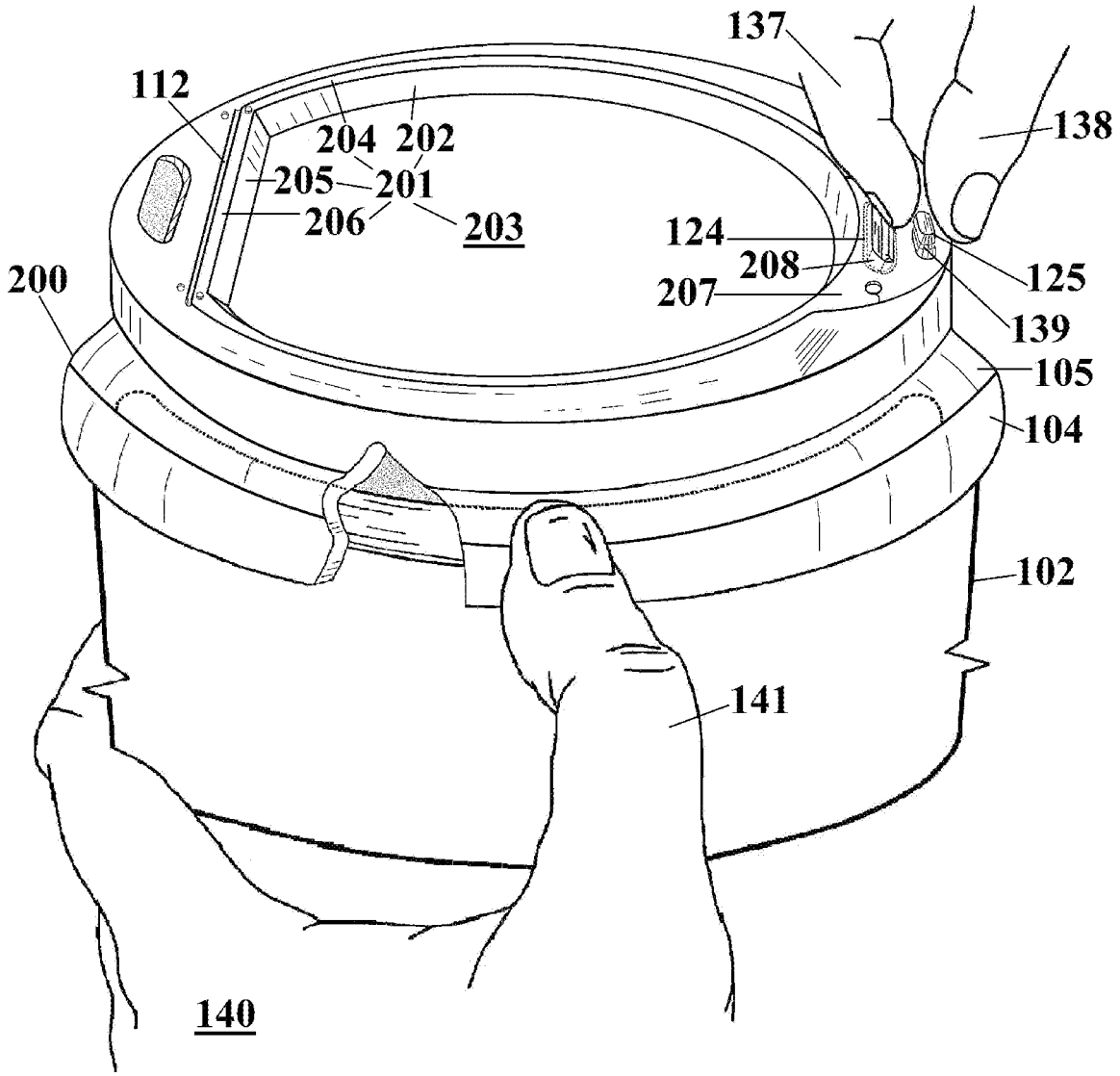
FIG. 8 is a perspective view showing a preferred embodiment of an alternative container lid shown in FIG. 7, constructed in accordance with the principles of the present invention showing an enclosed hatch cover in the process of being opened and/or closed.

FIG. 8 is a perspective view of alternative lid 200 showing another embodiment, in accordance with the present invention, with enclosed hatch cover 201 in the closed position showing gripping post 125 in the grasp of index finger 137 and thumb 138 (as seen in FIGS. 2 and 2A) initiating the lifting and rotation of enclosed hatch cover 201 to its opened position as shown in FIG. 9, or, alternatively, again referring to FIG. 9, rotating opened enclosed hatch cover 201 back to the closed position. Typically, but not necessarily, gripping post 125, may include a gripping means defined as a mid horizontal circumferential notch 139, bisecting the circumference of gripping post 125 at mid-height, to aid in grasping post 125.

Figure 9:
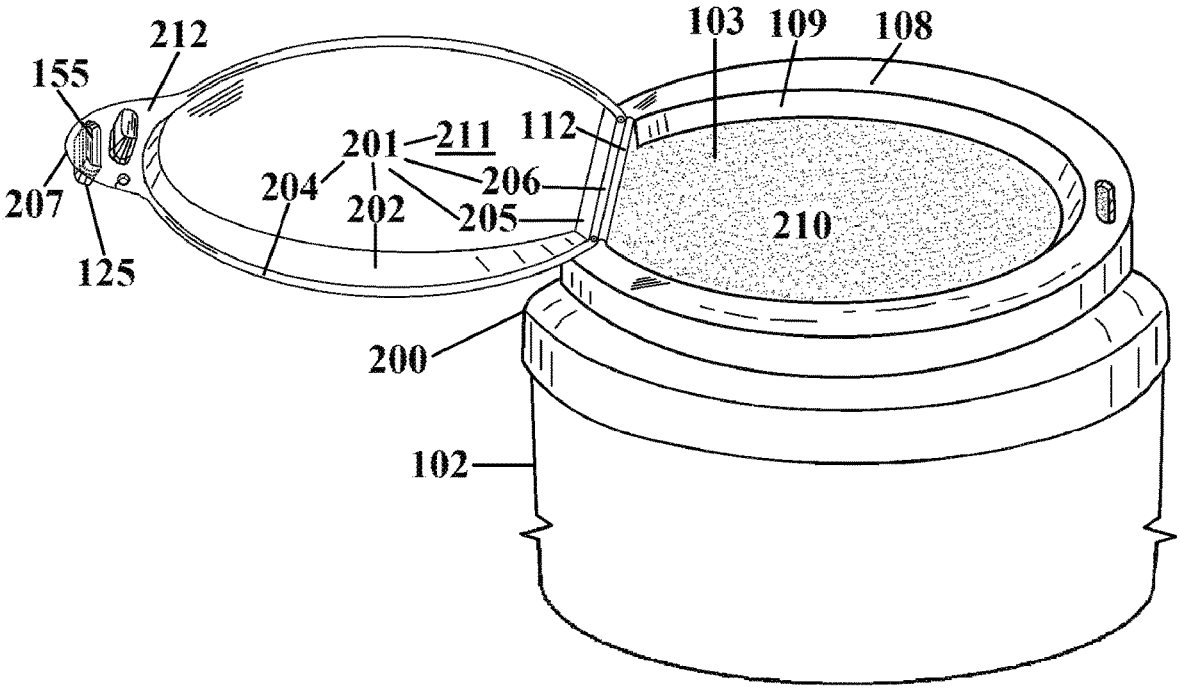
FIG. 9 is a perspective view showing a preferred embodiment of an alternative container lid shown in FIG. 7, constructed in accordance with the principles of the present invention with an enclosed hatch cover in the opened position.

The pulling of gripping post 125 upwards lifts integrated arcuate tab 207 upwards, releasing downstanding post 208 from secondary drinking access port 124. While gripping post 125 is being lifted upwards, opposing hand 140, is wrapped around container 102 (compressed for ease of illustration), with thumb 141 extended to apply downward pressure to flanges 104 and 105. This arrangement may change with handedness and repositioning of fingers and thumb. This positioning of hand 140 steadies container 102 and thumb 141 holds lid 200 down as gripping post 125 is pulled upwards, rotating enclosed hatch cover 201 180 degrees from a closed to an opened position (as shown in FIG. 9), articulating about hinge 112, pivoting enclosed hatch cover 201 back, behind hinge 112, such that opening and closing may be accomplished any number of times. Thus enclosed hatch cover 201 may be readily placed into its opened position by the customer or barrista, or put into its closed position by the customer or barrista, very quickly and reliably.

FIG. 9 is a perspective view of alternative lid 200 constructed in accordance with the principles of the present invention showing enclosed hatch cover 201 inverted in the opened position following completion of the operation described in FIG. 8, thereby creating a hatch opening 210 bordered by curved inside wall 109. Hatch opening 210 provides access to beverage 103 for dunking a confection 159, such as a biscotti, or performing another action such as expediting cooling of a hot beverage 103, adding further condiments or an organically flavoured infusion pouch, such as a tea bag, thereby eliminating the difficulty and associated risk of first removing lid 200 from container 102 (compressed for ease of illustration).

Curved inside wall 109 acts as a anti-splash/spill apron restricting any splashing of beverage 103 arising in hatch opening 210 from reaching onto top transition surface 108 and spilling out of container 102, possibly making contact with the consumer. Similarly, the opposite side of curved inside wall 109 also restricts splashing from the surface area of beverage 103, directly below top transition surface 108, from reaching hatch opening 210 and subsequently spilling onto top transition surface 108, making contact with the consumer, as previously detailed in FIG. 3A and further described in FIG. 9A.

Opposing, elevated inclined bottom surface 211 of inverted enclosed hatch cover 201, discloses a declining slope from a higher elevation at the distal end of inverted enclosed hatch cover 201, adjacent inverted integrated arcuate tab 207, to a lower elevation next to vertical rigid transition wall 205. Elevated inclined bottom surface 211 may be optionally used to rest an infusion pouch, retrieved from beverage 103 in container 102, following steeping in beverage 103. This optional resting area for a retrieved infusion pouch allows for any retained infused liquid remaining in the pouch to drain, cascading down elevated inclined bottom surface 211, passing over vertical rigid transition wall 205, integrated transition panel 206 and hinge 112, into hatch opening 210, returning to container 102, before the pouch is discarded. The elevated inclined bottom surface 211 of inverted enclosed hatch cover 201, and its relation to an infusion pouch will be further discussed in FIGS. 10A, 11A, and 13. Underside arcuate tab surface 212 of inverted integrated arcuate tab 207 discloses downstanding post 208 and gripping post cavity 155.

Figure 9B:
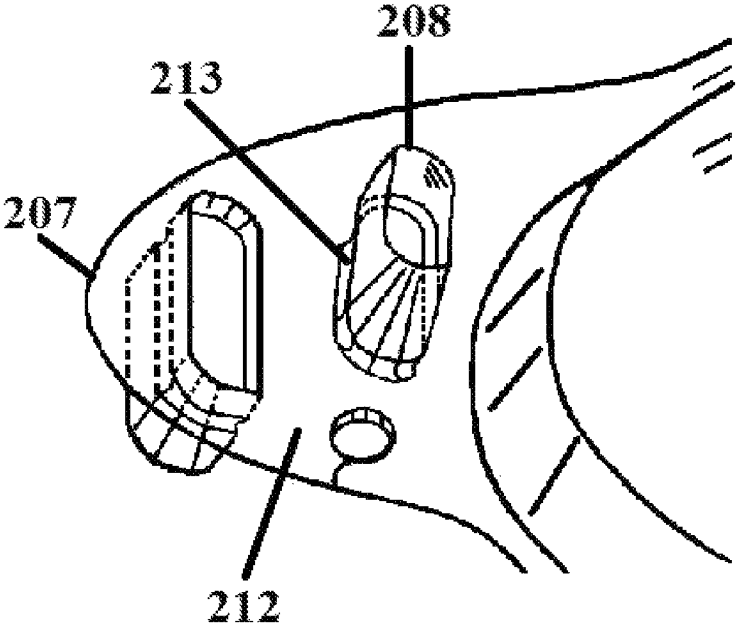
FIG. 9B is a partial perspective view, on a larger scale, of a portion of an alternative container lid in FIG. 9 showing a downstanding post on the underside of an integrated arcuate tab.
Figure 9A:
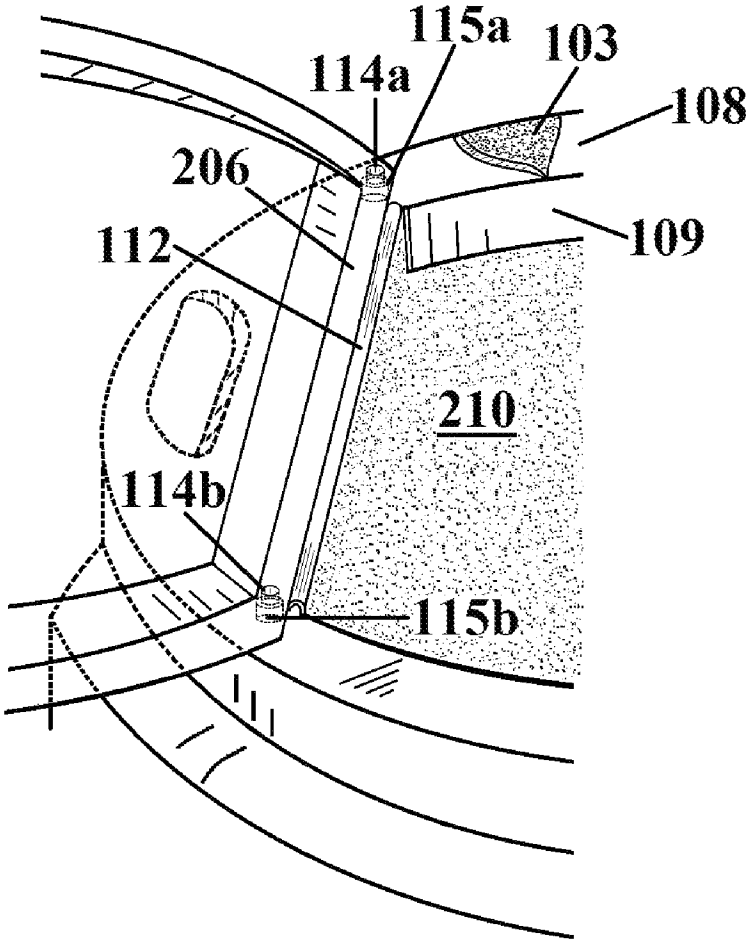
FIG. 9A is a partial perspective view, on a larger scale, of a portion of an alternative container lid shown in FIG. 9 showing the releasable locking of an enclosed hatch cover in the opened position with a cut-away portion in the top of the lid exposing beverage below the brim mount.

FIG. 9A is a partial perspective view, on a larger scale, of a portion of FIG. 9. In a further embodiment of the present invention twin posts 114*a* and 114*b* and twin cavities 115*a* and 115*b*, respectively, are equidistant from hinge 112, such that when enclosed hatch cover 201 is rotated 180 degrees about hinge 112, twin posts 114*a* and 114*b* are in registration directly above twin cavities 115*a* and 115*b*. This registration allows for optional gentle downward finger pressure to be applied to inverted integrated transition panel 206 to releasably frictionally seat twin posts 114*a* and 114*b* into twin cavities 115*a* and 115*b*, securing enclosed hatch cover 201 in the opened, fold back position, exposing hatch opening 210 for accessing beverage 103.

A cut-away in top transition surface 108 shows the dual actions of curved inside wall 109 acting as an anti-splash/spill apron restricting beverage 103, directly under top transition surface 108, from splashing into, and upwards, through hatch opening 210, and also restricting splashing from the surface of beverage 103 in hatch opening 210 area from splashing upwards and spilling onto top transition surface 108.

FIG. 9B is a partial perspective view, on a larger scale, of a portion of FIG. 9 showing the downstanding post 208 with upper horizontal circumferential notch 213 therein positioned at the upper end of downstanding post 208 adjacent the underside arcuate tab surface 212 of integrated arcuate tab 207. Upper notch 213 allows downstanding post 208 to be releasably snap fitted into secondary drinking access port 124, and, together with tapered walls of the continuous curved peripheral wall 202, bring enclosed hatch cover 201 and lip 204, respectively, into intimate contact with curved inside wall 109 and top transition surface 108 as seen in FIG. 7. This helps to provide a tight seal reducing possible leakage from container 102 when enclosed hatch cover 201 is in the closed position.

Figure 10:
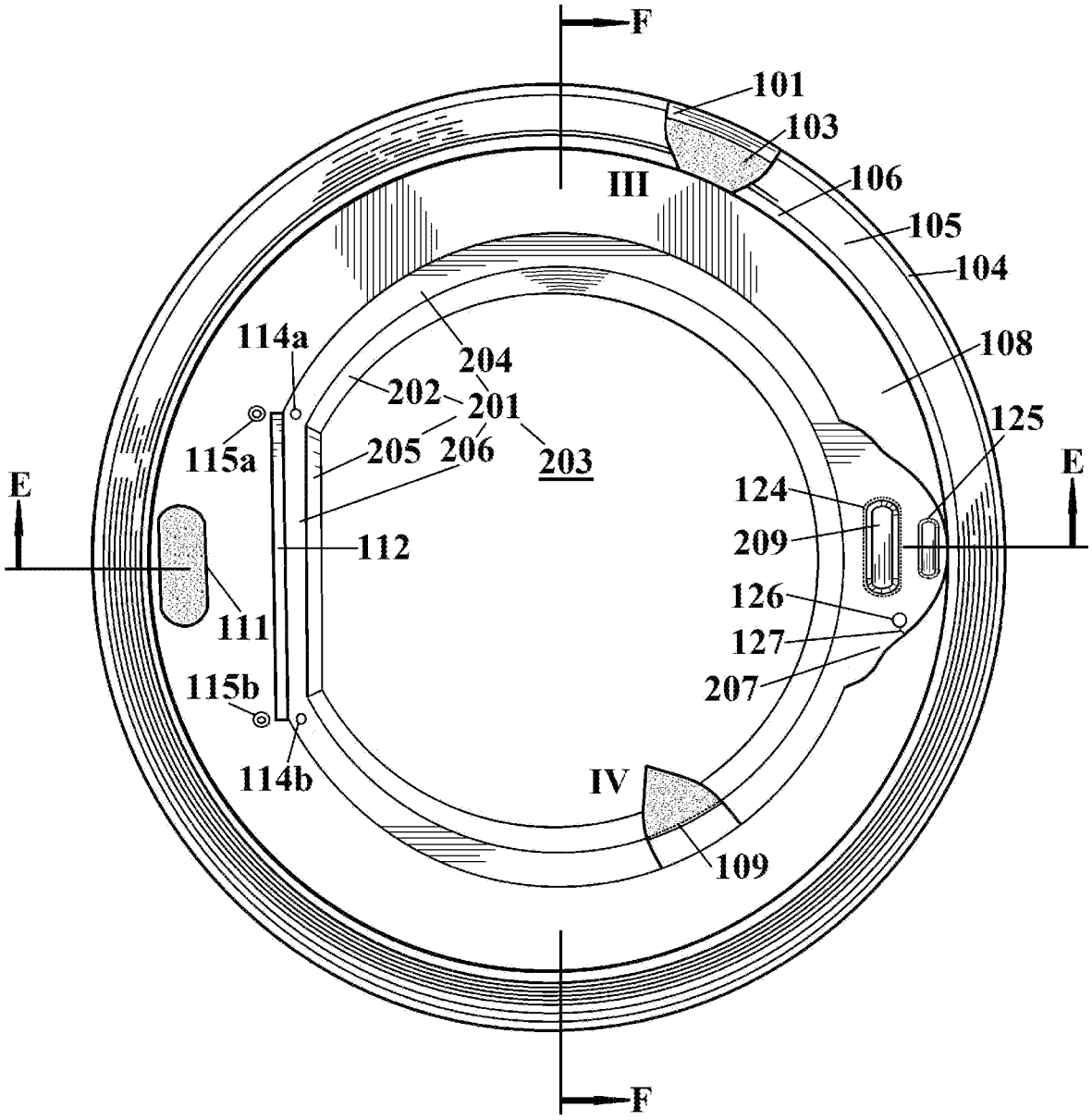
FIG. 10 is a top view of FIG. 7 with an enclosed hatch cover in the closed position with a first cut-away (III) portion in the top of the lid showing the engagement of the rim of the lid to the rolled rim of the container. A second cut-away (IV) portion in the top of the lid shows the contact interface between the enclosed hatch cover and the inside wall of the hatch opening.

FIG. 10 is a plan view of alternative lid 200 with enclosed hatch cover 201 in the closed position as seen in FIG. 7 showing the spatial relationship of several embodiments of the present invention. Proceeding from right to left along line E-E, cut-away (III) shows continuous flange 104 and transition flange 105 sealingly engaging rolled rim 101 with outside wall 106 interposed between transition flange 105 and top transition surface 108 and disclosing beverage 103.

Integrated arcuate tab 207, covers secondary drinking access port 124, and terminates where the outside edge of integrated arcuate tab 207 meets the top of outside wall 106 and where gripping post 125 protrudes vertically from the top surface of integrated arcuate tab 207. The top view shows downstanding post cavity 209 of downstanding post 208 (see also FIG. 10A), which is frictionally snap fitted into secondary drinking access port 124. String guide hole 126 and string entry slit 127, show their spatial relationship with the other embodiments embedded in integrated arcuate tab 207, all enjoying their own independent space on what first appears as a congested area.

Enclosed hatch cover 201 is comprised of lip 204 resting in intimate contact on top transition surface 108 and connected at one end to integrated transition panel 206 and at the opposite end, forming integrated arcuate tab 207. Lip 204 defines a continuous curved peripheral wall 202 with a wider circumference at the top and narrower circumference at the base creating a tapered wall, shaped and sized to engage the periphery of the hatch opening 210 and curved inside wall 109 (as seen in FIG. 7), when enclosed hatch cover 201 is in the closed position. A second cut-away (IV) shows the intimate contact between continuous curved peripheral wall 202 and curved inside wall 109. Continuous curved peripheral wall 202 connects at both ends to vertical rigid transition wall 205, interposed between integrated transition panel 206 and enclosed inclined top surface 203 of enclosed hatch cover 201. Lip 204 rests on top transition surface 108 in a sealed fashion when enclosed hatch cover 201 is in the closed position.

Integrated transition panel 206 is connected to hinge 112, which articulates 180 degrees rotating enclosed hatch cover 201 from the closed position to the fold backed, opened position. Adjacent to hinge 112 is primary drinking access port 111.

Twin posts 114*a* and 114*b* and twin cavities 115*a* and 115*b*, respectively, at the opposing ends, and on opposite sides of hinge 112, are equidistant from hinge 112 such that they are registered above one another when enclosed hatch cover 201 is rotated 180 degrees to the opened position.

Figure 10A:
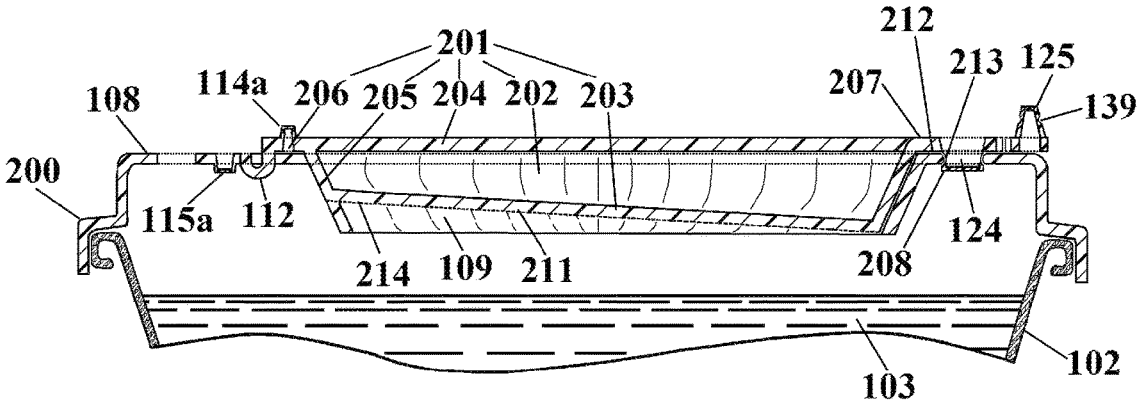
FIG. 10A is a cross-sectional view taken substantially along line E-E in FIG. 10 showing an alternative container lid mounted on a beverage filled container.

FIG. 10A is a cross-sectional view of alternative lid 200 of the present invention with enclosed hatch cover 201 in the closed position taken substantially along line E-E of FIG. 10. In another embodiment of the present invention downstanding post 208 forms dependently downward from underside arcuate tab surface 212 of integrated arcuate tab 207 and is releasably snap fitted into secondary drinking access port 124 where upper notch 213 retains enclosed hatch cover 201 in a closed position in intimate contact with top transition surface 108 to reduce possible leaking of beverage 103 through the contact points between the enclosed hatch cover 201 and curved inside wall 109.

Downstanding post 208 has a generally similar shape and embodiments to gripping post 125, with upper notch 213 located at the upper end of downstanding post 208 such that downstanding post 208 acts as a retainer plug or flexible closure snap post, releasably snap fitted into secondary drinking access port 124, bringing the underside arcuate tab surface 212 into intimate contact with top transition surface 108, thereby simultaneously releasably locking enclosed hatch over 201 in the closed position and also ensuring a tight seal, reducing any possible leaking of beverage 103 through these contact surfaces, which might arise as a result of splashing or tipping of container 102 (compressed for ease of illustration).

Enclosed hatch cover 201 is comprised of lip 204, continuous inside peripheral wall 202, enclosed inclined top surface 203, vertical rigid transition wall 205 and integrated transition panel 206. Enclosed hatch cover 201 is also retained in the closed position through continuous curved peripheral wall 202 contoured to frictionally fit the contour of curved inside wall 109 (see FIG. 10B) which is also tapered with a larger upper circumference and smaller lower circumference, both circumferences dimensionally larger than the upper and lower circumferences of continuous inside peripheral wall 202.

The snap fitment of downstanding post 208 into secondary drinking access port 124, together with the frictional matching of tapered continuous inside peripheral wall 202 with that of curved inside wall 109 combine to retain enclosed hatch cover 201 in the closed position.

Elevated inclined bottom surface 211 of enclosed hatch cover 201 discloses a bottom surface slope 214 from a lower elevation nearest to secondary drinking access port 124 to a higher elevation nearest to hinge 112. As described earlier in FIG. 9, when enclosed hatch cover 201 is rotated to the opened position it is inverted and elevated inclined bottom surface 211 is on top and bottom surface slope 214 is reversed for the purposes of resting an infusion pouch retrieved from beverage 103, thereby allowing the infusion pouch to drain residual infused beverage 103 down bottom surface slope 214 back into container 102 (further described under FIG. 13).

In another embodiment of the present invention vertical rigid transition wall 205 is defined by being both upwardly dependent from enclosed inclined top surface 203 and inwardly dependent from the terminal end sides of continuous inside peripheral wall 202. The top edge of vertical rigid transition wall 205 connects to integrated transition panel 206 which is integrated inwardly dependent on either side from the terminated ends of lip 204.

On one side of hinge 112 post 114*a* (also post 114*b* not shown in cross-section E-E) protrudes vertically from the surface of integrated transition panel 206 and on the opposite side of hinge 112, cavity 115*a* (also cavity 115*b* not shown in cross-section E-E) is recessed; both post 114*a* and cavity 115*a* (and post 114*b* and cavity 115*b*, not shown in cross-section E-E) are the same distance from hinge 112 thereby allowing post 114*a* to become registered above cavity 115*a* (and also the registration of post 114*b* above cavity 115*b*, not shown in cross-section E-E) when enclosed hatch cover 201 is rotated about hinge 112 180 degrees to the opened position.

Figure 10B:
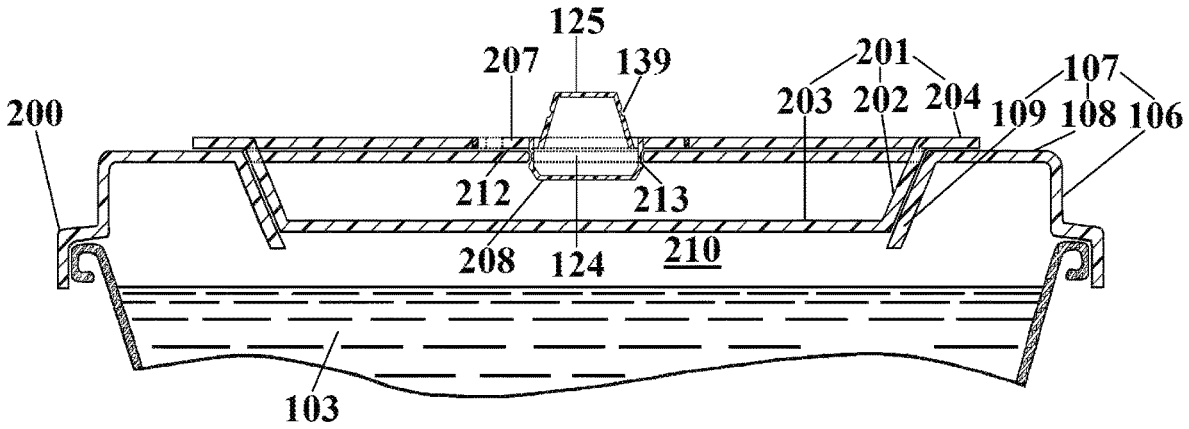
FIG. 10B is a cross-sectional view taken substantially along line F-F in FIG. 10 showing another view of an alternative container lid mounted on a beverage filled container.

FIG. 10B is a cross-sectional view of alternative lid 200 of the present invention with enclosed hatch cover 201 (as seen in FIGS. 10 and 10A and partially identified in FIG. 10B) in the closed position taken substantially along line F-F of FIG. 10. Enclosed hatch cover 201 is releasably locked in the closed position through two embodiments. In one embodiment continuous curved peripheral wall 202, contoured to frictionally fit the contour of curved inside wall 109, which is also tapered with a larger upper circumference and smaller lower circumference, both circumferences dimensionally larger than the upper and lower circumferences of continuous curved peripheral wall 202, thereby holding down enclosed hatch cover 201 via frictional fit. Another embodiment to releasably securing enclosed hatch cover 201 in the locked position utilizes downstanding post 208 whereby upper notch 213 enables downstanding post 208 to act as a retainer plug or flexible closure snap post, snapping into secondary drinking access port 124, whereby upper notch 213 is positioned near the base of downstanding post 208 bringing the underside arcuate tab surface 212 and the bottom surface of lip 204 into intimate contact with top transition surface 108, sealing enclosed hatch cover 201 and eliminating potential leaks through the interfaces of enclosed hatch cover 201 when in the closed position.

Gripping post 125 discloses mid notch 139 at mid-height repeating the design described in FIG. 2A, with the same function to further assist when grasping gripping post 125 to rotate enclosed hatch cover 201 to the opened position.

Curved inside wall 109 extends nominally below enclosed inclined top surface 203 and offers dual anti-splash/spill functionality. Curved inside wall 109 blocks splashing from beverage 103 in the area bordered by outside wall 106, top transition surface 108 and curved inside wall 109, which comprise brim mount 107, from possibly seeping out of the interfaces in hatch opening 210 area. Where the surface of curved inside wall 109 faces hatch opening 210 area, it again acts to stop splashing from seeping through the interfaces created by the contact points of enclosed hatch cover 201.

Figure 11:
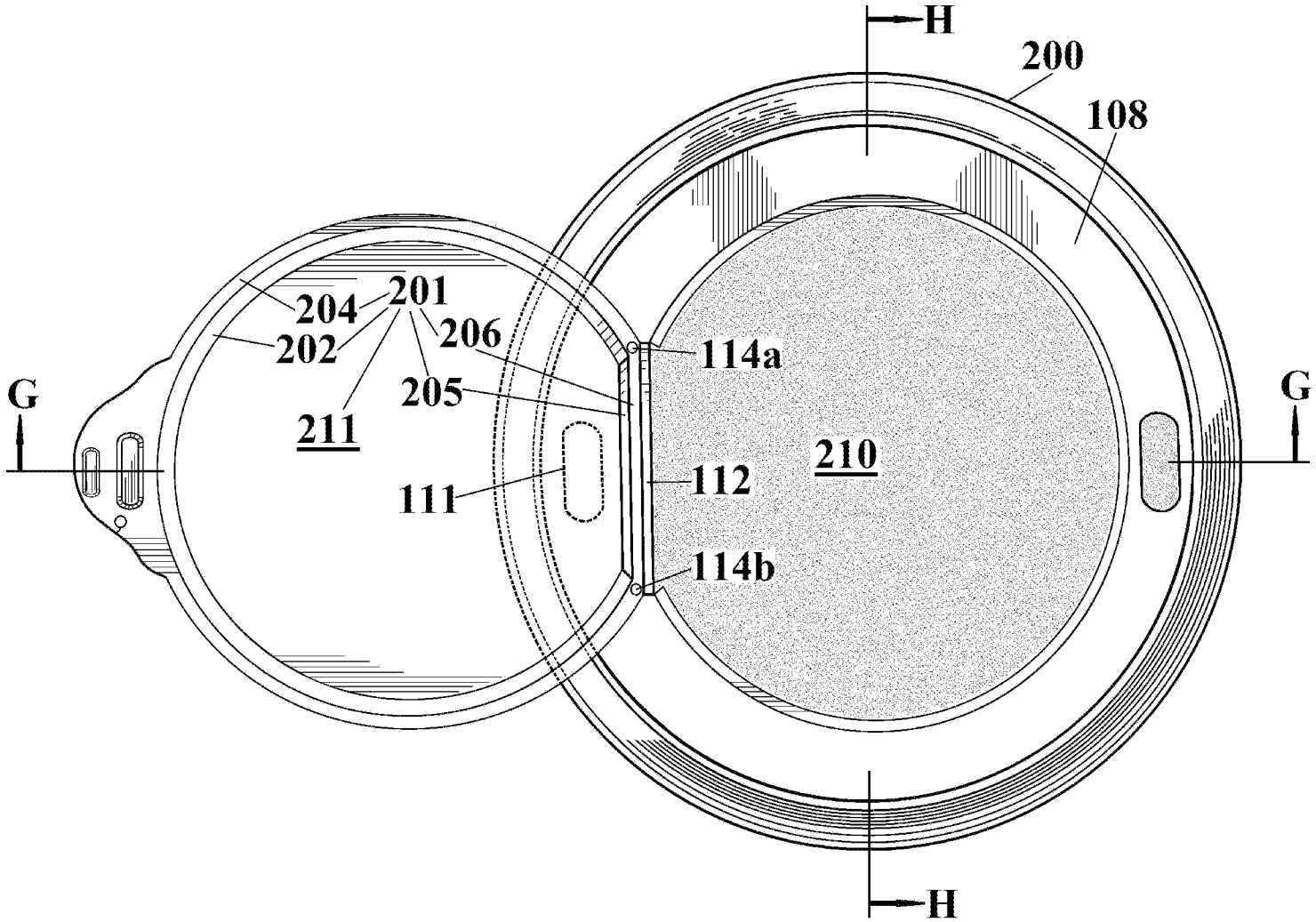
FIG. 11 is a top view of FIG. 9 showing an alternative container lid with an enclosed hatch cover in the opened position.

FIG. 11 is a plan view of alternative lid 200 with enclosed hatch cover 201 (comprised of components 202, 204, 205, 206, and 211), in the opened position as seen in FIG. 9 showing the spatial relationship of several embodiments of the present invention. Prior to rotating enclosed hatch cover 201 to the opened position, twin posts 114*a* and 114*b* and twin cavities 115*a* and 115*b*, respectively, are equidistant from each other on either side of hinge 112. Following rotation of enclosed hatch cover 201 to the opened position, twin posts 114*a* and 114*b* are placed in registration directly above twin cavities 115*a* and 115*b* at which point the consumer may select to optionally insert twin posts 114*a* and 114*b* into twin cavities 115*a* and 115*b*, respectively, through gentle downward finger pressure for the purposes of releasably locking enclosed hatch cover 201 in the opened position, keeping it remote from hatch opening 210. Once twin posts 114*a* and 114*b* are inserted into twin cavities 115*a* and 115*b* they bring the inverted top surface of lip 204 into intimate contact with top transition surface 108.

Following rotation, enclosed hatch cover 201 becomes inverted exposing elevated inclined bottom surface 211 which is sloped downwards from a high elevation nearest integrated arcuate tab 207 to a lower elevation adjacent vertical rigid transition wall 205, thereby allowing for the consumer to optionally retrieve an organically flavoured infusion pouch after suitable steeping time in container 102, for the purpose of resting infusion pouch on elevated inclined bottom surface 211 to further drain residual infused beverage 103 down bottom surface slope 214 back into hatch opening 210 and container 102. Following this draining infusion pouch is discarded. This embodiment will be further expanded upon in FIGS. 12 and 13.

FIG. 11 further illustrates the substantive area of hatch opening 210 available for performing different functions, such as, but not limited to, dunking a confection 159, adding condiments, stirring the beverage, scooping out toppings, and cooling the beverage when enclosed hatch cover 201 is in the opened position, without the risky requirement of first removing lid 200 and subsequently reattaching lid 200 following these activities. Enclosed hatch cover 201 is simply returned to its closed position, sealing hatch opening 210, thereby allowing the consumer to return to sipping beverage 103 from primary drinking access port 111, either in a stationary position or while on the move. It is noted that lid 200 does not include the retaining ridge rib 110 defined for lid 100, consequently the surface area of hatch opening 210 created when enclosed hatch cover 201 is rotated to the opened position may be marginally larger compared with the surface area of hatch opening 150 created when hatch cover 116 is rotated to the opened position for lid 100 (as shown in FIG. 3).

Figure 11A:
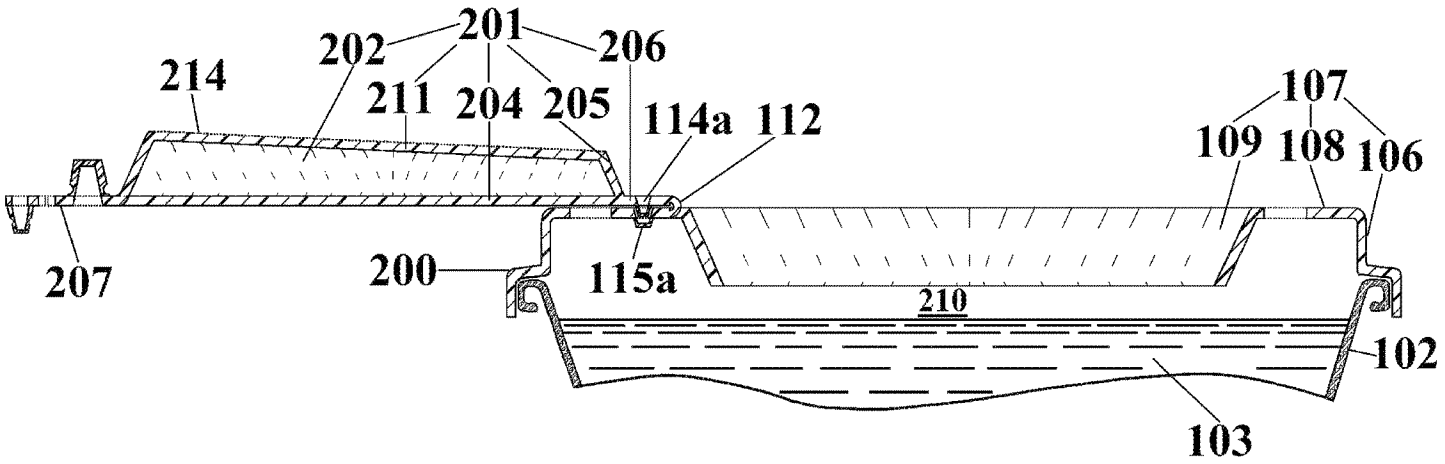
FIG. 11A is a cross-sectional view taken substantially along line G-G in FIG. 11 showing an alternative container lid with an enclosed hatch cover in the opened position.

FIG. 11A is a cross-sectional view of alternative lid 200 of the present invention with enclosed hatch cover 201 (comprised of components 202, 204, 205, 206, 211, as seen in FIGS. 9, 10A and 11) in the opened position taken substantially along line G-G of FIG. 11. The elevated inclined bottom surface 211 if further defined by a bottom surface slope 214 downward from a higher elevation nearest integrated arcuate tab 207 to a lower elevation adjacent vertical rigid transition wall 205 and may be optionally used to rest an organic flavoured infusion pouch following retrieval of the pouch from container 102 (compressed for ease of illustration) for subsequent draining of residual infused beverage 103 back through the hatch opening 210 into container 102.

Hinge 112 is sufficiently flexible to allow enclosed hatch cover 201 to remain substantially in the opened position. However, the consumer may optionally choose to insert twin posts 114*a* (and 114*b*, not shown) into twin cavities 115*a* (and 115*b*, not shown), respectively, releasably retaining enclosed hatch cover 201 in the opened position following 180 degree rotation, thereby ensuring unobstructed access to hatch opening 210 for accessing beverage 103 for dunking a confection 159 or performing other actions on beverage 103.

Hatch opening 210 created by the rotation of enclosed hatch cover 201 to the opened position creates a suitable area for easy dunking of a confection 159 into beverage 103 in container 102 or performing other functions on beverage 103 such as expediting cooling of a hot beverage or adding condiments.

Curved inside wall 109 offers a dual anti-splash/spill functionality restricting splashing arising from beverage 103 in the area below brim mount 107 defined by outside wall 106, top transition surface 108 and the outside surface of curved inside wall 109, from reaching hatch opening 210 and spilling over top transition surface 108. Conversely, the inside surface of curved inside wall 109 restricts splashing arising in hatch opening 210 from rising onto top transition surface 108 and possibly making contact with the consumer.

Splashed beverage hits curved inside wall 109 and cascades downward returning to beverage container 102.

Figure 11B:
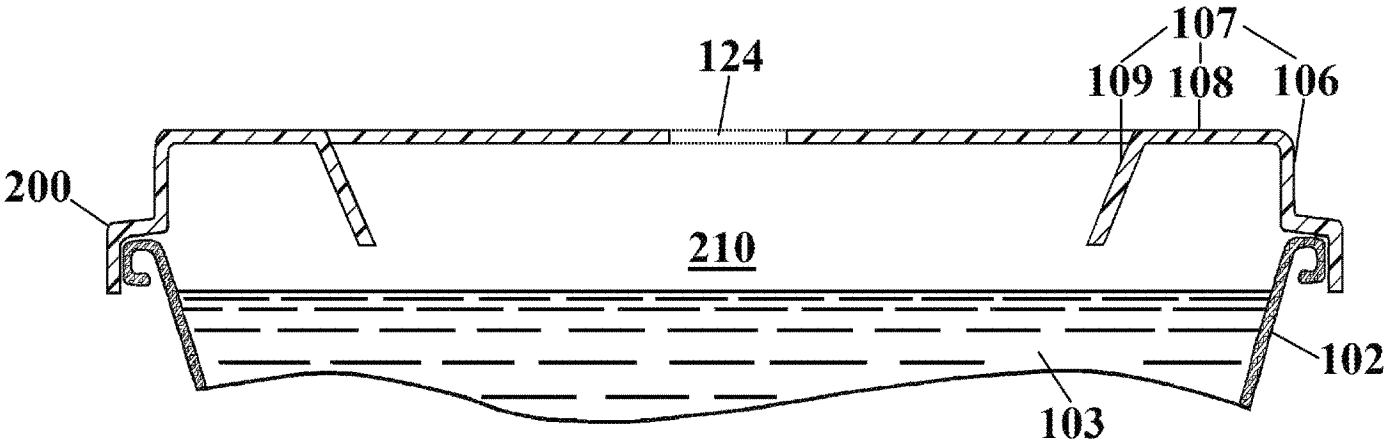
FIG. 11B is a cross-sectional view taken substantially along line H-H in FIG. 11 showing another view of an alternative container lid with an enclosed hatch cover in the opened position.

FIG. 11B is a cross-sectional view of alternative lid 200 of the present invention with enclosed hatch cover 201 in the opened position (not shown) taken substantially along line H-H of FIG. 11. Curved inside wall 109 again demonstrates its dual functioning anti-splash/spill apron, whereby curved inside wall 109 deflects splashed beverage arising from the surface area of beverage 103 in the area below brim mount 107, thereby preventing splashing from reaching hatch opening 210 and possibly spilling onto top transition surface 108 and potentially making contact with the consumer. Similarly, the opposite surface of curve inside wall 109 faces hatch opening 210 and again acts to deflect splashing of beverage 103 arising from the surface area directly below hatch opening 210 and bordered by curved inside wall 109, such that when splashing does arise it will hit curved inside wall 109 and cascade down the wall returning to container 102 (compressed for ease of illustration).

Figure 12:
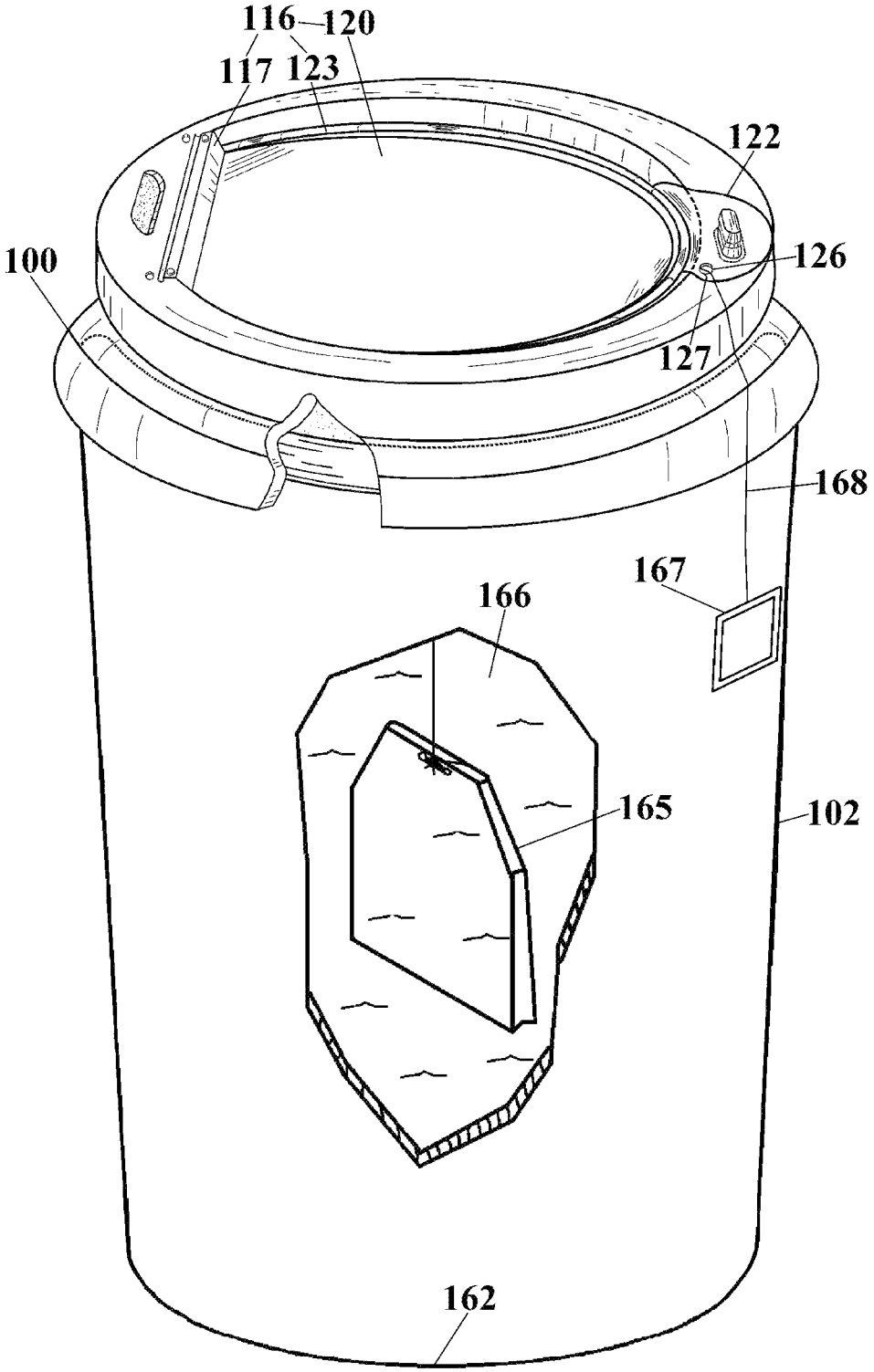
FIG. 12 is a perspective view of another preferred embodiment of the container lid shown in FIG. 1, constructed in accordance with the principles of the present invention with the hatch cover in the closed position with a cut-away in the side wall of the container showing a suspended infusion pouch.

FIG. 12 is a perspective view of lid 100 attached to container 102 with hatch cover 116 in the closed position as described in FIG. 1. In another embodiment of the present invention, an organically flavoured, infusion pouch 165, such as a tea bag for example, is placed in a container 102 filled with hot or cold water 166 by first lifting hatch cover 116 to its opened position exposing hatch opening 150 (as seen in FIGS. 2 and 3). Infusion pouch tag 167 or infusion pouch string 168, or combination thereof, is gripped by the fingers of either hand to manoeuver infusion pouch string 168 through slit 127, into string guide hole 126, of arcuate tab 122. Once string 168 is in string guide hole 126 it will move up and down freely, thereby allowing consumer to lower infusion pouch 165 to a suitable depth in container 102. Once depth of infusion pouch 165 is determined, string 168 may then be optionally pulled back into slit 127 and allowed to remain wedged in slit 127 thereby suspending infusion pouch 165 at the preferred depth to steep.

Retaining infusion pouch 165 at mid height in a container maximizes infusion of hot liquid 166 by taking advantage of convection to more evenly diffuse the organic flavour which might not otherwise be achieved if infusion pouch 165 were allowed to rest on the container bottom 162. While infusion pouch 165 is steeping, hatch cover 116 may be optionally returned to its closed position to retain heat. Suspended infusion pouch 165 is viewable through a cut-away window in the wall of container 102.

The procedure for suspending infusion pouch 165 in container 102, and optionally wedging string 168 into slit 127, may vary from person to person and does not preclude merely using slit 127 to bring string 168 into string guide hole 126 and not suspend infusion pouch 165 at a suitable depth, but to rather let infusion pouch 165 rest on container bottom 162. FIG. 12 illustrates an infusion pouch 165 suspended through hatch cover 116 of lid 100, however, the same process and arrangement for suspending an infusion pouch 165 would be shown utilizing alternative lid 200 and enclosed hatch cover 201 with the same embodiments for suspending infusion pouch 165 as described for hatch cover 116.

Figure 13:
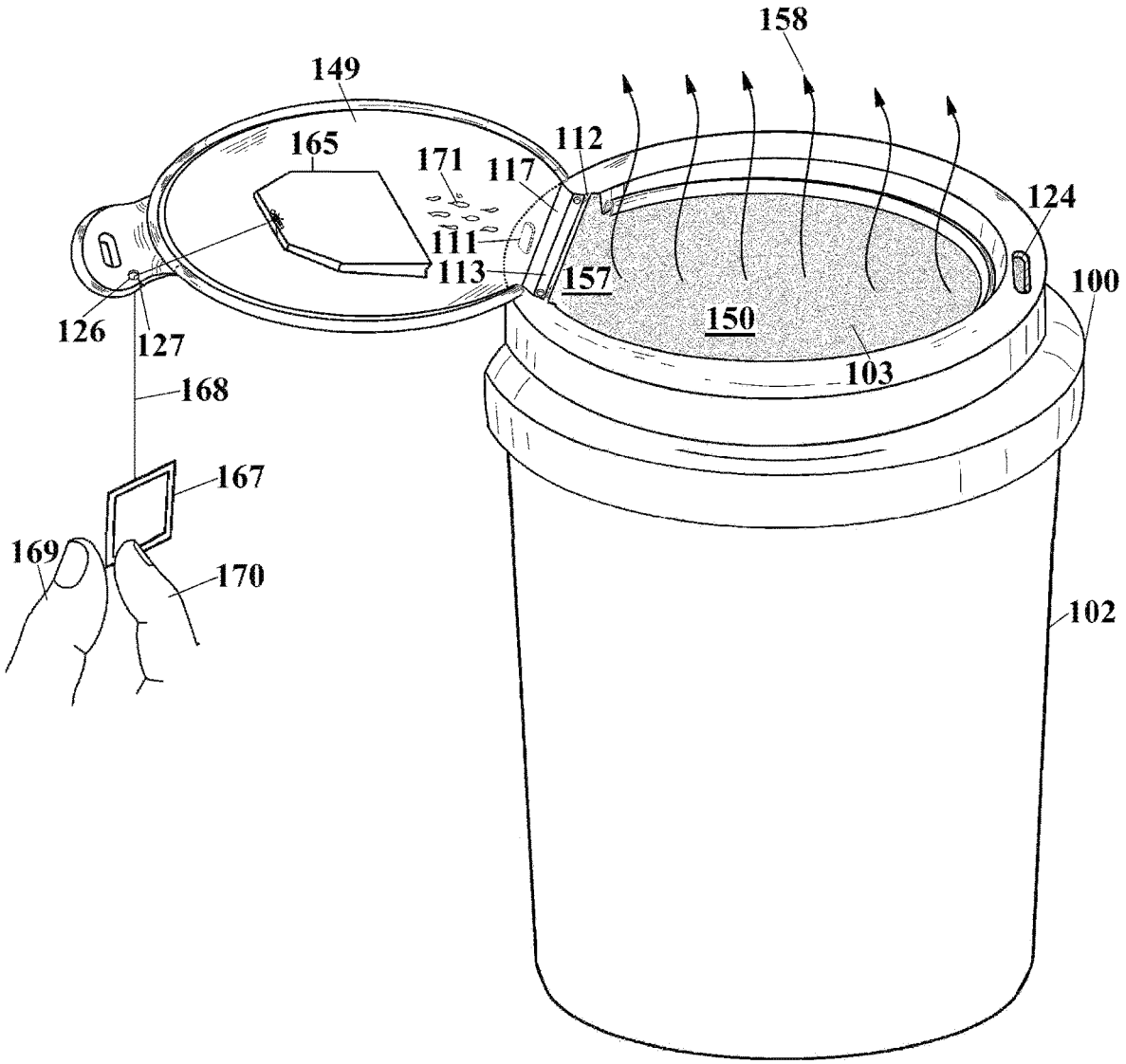
FIG. 13 is a perspective view of another preferred embodiment of the container lid shown in FIG. 1, constructed in accordance with the principles of the present invention with the hatch cover in the opened position and an organically flavoured infusion pouch on the inverted inclined bottom surface of the enclosed hatch cover, draining residual beverage from an infusion pouch through a hatch opening back into a container.

FIG. 13 is a perspective view of lid 100 attached to beverage 103 filled container 102 with hatch cover 116 in the opened position with infusion pouch 165 resting on inverted inclined bottom surface 149 of hatch cover 116. Heat arrows 158 signify heat in the form of steam escaping from beverage 103 through hatch opening 150, demonstrating one of many functions offered by hatch cover 116; in this case cooling a hot beverage 103, again without necessitating the complete removal of lid 100 from container 102.

When hatch cover 116 has been rotated 180 degrees about hinge 112 to the opened position twin posts 114*a* and 114*b* are optionally frictionally fitted into twin cavities 115*a* and 115*b*, respectively, thereby retaining hatch cover 116 in a rigid opened position remote from hatch opening 150 (as shown in FIGS. 3 and 3A).

At such time as the customer is satisfied with the degree of flavoured infusion passed from pouch 165 to beverage 103, they may grasp tag 167 between thumb 169 and index finger 170, moving string 168 from slit 127 back into string guide hole 126 and retrieve infusion pouch 165 from container 102, pulling it onto inclined bottom surface 149, whereby residual infused beverage 171 drains down inclined bottom surface 149 passing over inverted articulating wall 117, inverted rigid connecting panel 113 and rotated hinge 112, flowing into space 157, through hatch opening 150 back into container 102 thereby further maximizing infusion of beverage 103. Once infusion pouch 165 has been satisfactorily drained thumb 169 and index finger 170 remove string 168 from string guide hole 126, guiding string 168 through slit 127 freeing string 168, whereby infusion pouch 165 is lifted from inclined bottom surface 149 and discarded. The choice of hand and fingers for the aforementioned operation may vary with consumer.

After infusion pouch 165 is discarded, hatch cover 116 may again be optionally rotated 180 degrees from the open to the closed position, again sealing hatch opening 150, keeping beverage 103 hot while the consumer sips from primary drinking access port 111, or, alternatively, hatch cover 116 may remain in the opened position to perform further operations on beverage 103 such as dunking a confection 159 while the consumer alternately sips from secondary drinking access port 124.

The absence of a string guide hole 126, slit 127, and inclined bottom surface 149 for further draining infusion pouch 165, reduces the safe management of an infusion pouch 165 infused with hot beverage 103, making draining of any residual beverage 103 from an infusion pouch 165 back into container 102 messy, and subsequent handling of a hot infusion pouch 165 a delicate challenge when discarding. In such absences, tag 167 is gripped between the consumer's fingers and pulled completely from container 102 with residual or retained hot beverage 103 dripping from infusion pouch 165, creating a mess around container 102 and possibly dripping beverage 103 onto the consumer. Furthermore, without the recessed reclosable hatch cover 116 described for the present invention, there is the added requirement and risk of removing lid 100 to deposit an infusion pouch 165 into a hot beverage 103 and subsequently reattaching lid 100 to rolled rim 101 of container 102, once infusion pouch 165 has been retrieved and discarded, possibly leading to other accidents and possible injury from hot beverage 103. The above described problems and risks associated with inserting infusion pouch 165 into a beverage 103 filled container 102 are avoided with this new container lid.

Figure 14:
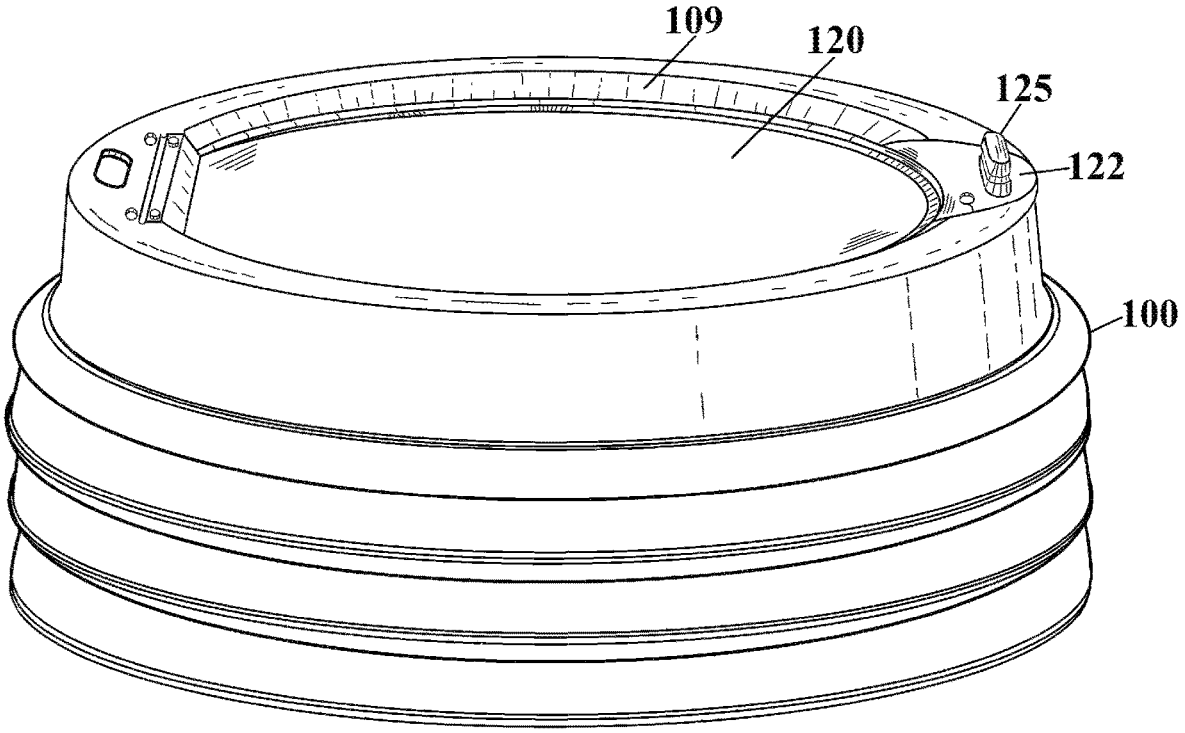
FIG. 14 is a perspective view of the container lid shown in FIG. 1 in a stacking arrangement.

FIG. 14 is a perspective view of a plurality of lids 100, in accordance with the embodiments of FIG. 1, stacked together, such as for purposes of storage or in preparation for use. Hatch cover 116 and arcuate tab 122 have been designed to allow lids 100 to be stacked for access and space accommodations. Similarly, alternative lid 200 may also be stacked in a similar manner for the same purposes, as enclosed hatch cover 201 and integrated arcuate tab 207 have been similarly designed to accommodate stacking.

Curved inside wall 109, the skirt forming the hatch opening, tapers from the top edge where it is downwardly dependent from top transition surface 108 to the base of curved inside wall 109 below inclined top surface 120 of hatch cover 116 such that hatch opening 150, in the plane of top transition surface 108, is larger in diameter than the diameter at the base of hatch opening 150 around the base of the curved inside wall 109, thereby allowing hatch cover 116 to nest within the lower curved portion of curved inside wall 109 for stacking. Hatch cover 116 has arcuate tab 122 projecting outwardly extending therefrom with gripping post 125 which aids in the closing and opening of hatch cover 116 and when stacked fits into gripping post cavity 155 (as shown in FIG. 3) of gripping post 125 on the underside of arcuate tab 122.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the present invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

It is further noted that different embodiments illustrated are not foreign but merely applied in a different manner as defined by this invention. Coffee users are familiar with a variety of delivering containment formats both of a disposable and a reusable configuration for lids and containers such that while those illustrated above may seem complex, the use of ribs, channels and post for closing hatch covers as well for the purposes of keeping such hatch covers open have been adopted and used in different applications or suitably modified to fit the invention.

As to a further discussion of the manner of usage and operation of the present invention, the same should be apparent from the above description. Accordingly, no further discussion relating to the manner of usage and operation will be provided.

Although the present invention has been described and illustrated in detail, it is clearly understood that the same is by way of illustration and example only and is not to be taken by way of limitation, the spirit and scope of the invention being limited only by the terms of the appended claims.

What is claimed is:

1. A container lid having a hatch cover in a top portion covering a centrally positioned annular hatch opening wherein said container lid is configured to be reversibly secured onto an upper end rolled rim of a container having a substantially circular opening at its upper end, the container lid comprising:

wherein said container lid is made from a resilient material comprising at least one of thermoplastic, non-thermoplastic, rubber, or paper that is configured to be moulded, thereby offering contact lubricated properties:

the container lid having a peripheral rim portion configured to be sealingly reversibly securable to said upper end rolled rim of said container with the top portion of said lid having a first elevated planar region further defined by an elevated annular top tract panel defining a ring-shaped brim mount with a primary and a secondary drinking access ports arranged in a diametrically opposed positional relationship and die-cut into a top transition surface of said elevated annular top tract panel defining said brim mount;

and a second recessed substantially planar region within said hatch cover;

wherein said brim mount is further comprised of an annular outside wall, an annular top transition surface, inwardly dependent from said outside wall, an annular curved inside wall downwardly dependent from said top transition surface encircling said centrally positioned annular hatch opening;

wherein said peripheral rim portion is further comprised of a circumferential annular inclined transition flange outwardly dependent from a base of said outside wall, a circumferential outer perimeter continuous annular flange is downwardly dependent from said transition flange, whereby said transition flange and said continuous annular flange work in combination as a rim-engaging means adapted to engage said upper end rolled rim of said container in a mutually releasable semi-locking relationship;

wherein said hatch cover further comprises an inclined top surface, wherein said hatch cover is formed from an annular continuous curved peripheral wall upwardly dependent from said inclined top surface, an annular horizontally planar peripheral lip outwardly dependent from an top of said continuous curved peripheral wall in contact with said top transition surface of said brim mount;

wherein said continuous curved peripheral wall has a wider circumference at the top and narrower circumference at a base creating a tapered wall, shaped and sized for frictionally fitment within said curved inside wall of said brim mount with a larger upper circumference and smaller lower circumference, both circumferences dimensionally larger than the upper and lower circumferences of said continuous curved peripheral wall;

wherein said mainly annular horizontally planar peripheral lip is further comprised of an outwardly extending, integrated planar arcuate tab further comprising an upstanding vertical gripping post, a die-cut string guide hole, a die-cut string entry slit and a downwardly depending downstanding vertical snap-fitting post reversibly snap fitting into said secondary drinking access port; and wherein said gripping post is configured to be easily grasped between a thumb and index finger, a hinge is formed at least partially along one side of a portion of said top transition surface of said brim mount interposed between said primary drinking access port on one side of said hinge and an integrated planar rigid transition panel on an opposite side of said hinge, wherein the side of said rigid transition panel, distal from said hinge, is further connected to a substantially vertical rigid transition wall downwardly dependent connecting at its base to said inclined top surface of said hatch cover and bounded on either side between terminal ends of said annular continuous curved peripheral wall of said hatch cover, wherein a pair of twin, low profile, spaced, upstanding opposing posts, each post positioned at opposite ends of said rigid transition panel, on the one side of said hinge, are directly opposite a pair of twin, low-depth, spaced, dimensionally larger cavities therein said top transition surface of said brim mount on the opposite side of said hinge such that said twin posts and said twin cavities are equidistant from each other on either side of said hinge;

wherein said hinge enables said hatch cover to be rotated 180 degrees from a closed position to an opened position exposing said hatch opening of sufficient size to dunk a confection into a beverage in said container without first removing said container lid from said container rim; and wherein said hatch cover in said opened position inverts said inclined top surface positioning an opposing elevated inclined bottom surface facing upwards providing said inclined bottom surface to rest an organically flavoured infusion pouch, retrieved from said container to drain residual infused beverage from said pouch down said elevated inclined bottom surface through said hatch opening back into said container.

2. The container lid of claim 1, wherein said container lid is dome shaped and said hatch cover is configured to be deposed above said upper end rolled rim of said container, wherein said container lid is further comprised of said transition flange and said continuous flange downwardly dependent therefrom forming said rim-engaging means configured to be reversibly sealingly secured to said upper end of said rolled rim frictionally fitted therein to said container.

3. The container lid in claim 1, wherein said first planar region is deposed above said second recessed substantially planar region, wherein said first planar region is further defined as said elevated annular top tract panel defining said ring-shaped brim mount and is further comprised of said primary and said secondary drinking access ports in diametrically opposed positions die-cut into said top transition surface of said elevated annular top tract panel defining said brim mount;

wherein said elevated annular top tract panel defining said brim mount is further comprised of said outside wall, said top transition surface, inwardly dependent from said outside wall, said curved inside wall downwardly dependent from said top transition surface enclosing said hatch opening;

wherein said curved inside wall of said brim mount is tapered with said wider circumference at the top and said narrower circumference at the base; and wherein said second recessed substantially planar region is configured to accommodate a lip and a nose of a consumer when the consumer is tilting said container and drinking from said primary drinking access port.

4. The container lid in claim 3, wherein said hinge is a resilient recessed variable U-shaped hinge.

5. The container lid in claim 3, wherein said second recessed substantially planar region is further defined as said cover, wherein said hatch cover is further comprised of said inclined top surface;

wherein said hatch cover is formed from said continuous curved peripheral wall upwardly dependent from said enclosed inclined top surface having said wider circumference at the top and said narrower circumference at the base creating said tapered wall;

wherein said continuous curved peripheral wall is further comprised of said lip outwardly dependent from the top of said continuous curved peripheral wall whereby said lip resides in intimate contact on top of said top transition surface of said brim mount;

whereby said continuous curved peripheral wall is shaped and sized for frictionally fitment within said curved inside wall thereby retaining said hatch cover in the closed position.

6. The container lid in claim 3, wherein said hatch cover rotates substantially 180 degrees between the closed and the opened position about said hinge, wherein said hatch cover rotated 180 degrees to said opened position exposes said hatch opening;

wherein said hatch opening is said centrally positioned, mainly annular hatch opening; and whereby the confection is configured to be dunked through said hatch opening into said infused beverage in said container without removing said container lid from said rolled rim.

7. The container lid in claim 5 wherein said mainly annular horizontally planar peripheral lip is further comprised of said outwardly extending, integrated planar arcuate tab extending therefrom, wherein said integrated arcuate tab is further comprised of said gripping post, said string guide hole, said string entry slit, and said downstanding post;

wherein said gripping post is further comprised of a gripping means therein defined as a mid horizontal circumferential notch positioned at mid-height;

wherein said down standing post is further comprised of a gripping means defined as an upper horizontal circumferential notch therein positioned at the upper end of said downstanding post adjacent the underside of said integrated arcuate tab;

wherein said downstanding post releasably snap fits into said secondary drinking access port thereby bringing an underside of said integrated arcuate tab into contact with said top transition surface defining said brim mount;

whereby said gripping post may be easily grasped between said thumb and said index finger and pulled upwards to release said downstanding post out of said secondary drinking access port, thereby allowing said hatch cover to be rotated between said opened and said closed positions.

8. The container lid in claim 5, wherein said hatch cover is rotated 180 degrees to said opened position placing said twin posts in registration above said twin cavities to be frictionally inserted into said twin cavities thereby releasably retaining said hatch cover in said opened position.

* * * * *